US010465513B2

(12) United States Patent
Latham

(10) Patent No.: US 10,465,513 B2
(45) Date of Patent: Nov. 5, 2019

(54) TAPERED CUTTER BIT AND MOUNTING BLOCK FOR THE SAME

(71) Applicant: Winchester E. Latham, Avon, IN (US)

(72) Inventor: Winchester E. Latham, Avon, IN (US)

( * ) Notice: Subject to any disclaimer, the term of this patent is extended or adjusted under 35 U.S.C. 154(b) by 0 days.

(21) Appl. No.: 15/894,715

(22) Filed: Feb. 12, 2018

(65) Prior Publication Data

US 2018/0163539 A1 Jun. 14, 2018

Related U.S. Application Data

(63) Continuation-in-part of application No. 15/196,957, filed on Jun. 29, 2016, now Pat. No. 9,890,635, which is a continuation of application No. 14/262,918, filed on Apr. 28, 2014, now Pat. No. 9,382,794, which is a continuation-in-part of application No. 14/136,063, filed on Dec. 20, 2013, now Pat. No. 9,394,787.

(51) Int. Cl.

| | |
|---|---|
| ***E21C 35/183*** | (2006.01) |
| ***E21C 35/193*** | (2006.01) |
| ***E21C 25/10*** | (2006.01) |
| ***B28D 1/18*** | (2006.01) |

(52) U.S. Cl.

CPC ..... *E21C 35/183* (2013.01); *B28D 1/186* (2013.01); *B28D 1/188* (2013.01); *E21C 25/10* (2013.01); *E21C 35/193* (2013.01); *E21C 35/1936* (2013.01)

(58) Field of Classification Search

CPC .... E21C 35/183; E21C 25/10; E21C 35/1936; E21C 2035/1816; B28D 1/188; B28D 1/186

See application file for complete search history.

(56) References Cited

U.S. PATENT DOCUMENTS

| | | | | |
|---|---|---|---|---|
| 2,689,108 A | | 9/1954 | Haglund | |
| 3,351,998 A | * | 11/1967 | Theiler | B23B 51/0466 407/118 |
| 3,429,617 A | | 2/1969 | Lauber | |
| 3,487,865 A | | 1/1970 | Chapman et al. | |
| 3,598,447 A | * | 8/1971 | Bower, Jr. | E21C 35/18 299/103 |
| 3,666,321 A | | 5/1972 | Lundstrom et al. | |
| 3,726,352 A | | 4/1973 | Roos | |
| 4,072,437 A | * | 2/1978 | Smith | B23C 5/22 407/118 |
| 4,609,227 A | | 9/1986 | Wild et al. | |
| 4,936,516 A | | 6/1990 | Hench | |

(Continued)

*Primary Examiner* — Carib A Oquendo

(74) *Attorney, Agent, or Firm* — Brinks Gilson & Lione

(57) ABSTRACT

A cutter bit adapted to be fixed onto a working surface of a rotating drum of a milling, planing, mining or reclaiming machine is provided. The body of the cutter bit is generally formed of a hardened steel, the cutting surface may be a diamond composition fixed in a step in the upper end of the cutter bit. The cutter bit includes a cutting surface, and the cutting surface may include non-parallel side edges and an upper cutting edge parallel to a lower edge. The lower edge may be any length sufficient to inhibit unintended angular displacement of the cutting surface during operation of the working surface. Alternatively or in addition, the cutting surface may be defined by three edges to allow the cutting surface to be removed and repositioned in at least a second orientation.

20 Claims, 20 Drawing Sheets

(56) References Cited

U.S. PATENT DOCUMENTS

| | | | | |
|---|---|---|---|---|
| 5,052,757 | A | 10/1991 | Latham | |
| 5,146,963 | A | 9/1992 | Carpenter et al. | |
| 5,348,065 | A | 9/1994 | Meyer | |
| 5,971,305 | A | 10/1999 | Davenport | |
| 6,523,768 | B2 | 2/2003 | Recker et al. | |
| 7,108,212 | B2 | 9/2006 | Latham | |
| 7,290,726 | B2 | 11/2007 | Latham | |
| 7,338,134 | B2 | 3/2008 | Latham | |
| 7,959,099 | B1 * | 6/2011 | Cox | B02C 18/18 241/294 |
| 8,033,308 | B2 | 10/2011 | Stager | |
| 8,079,431 | B1 | 12/2011 | Cooley et al. | |
| 8,424,974 | B2 | 4/2013 | Latham | |
| 8,430,009 | B2 | 4/2013 | Micacchi | |
| 8,501,144 | B1 | 8/2013 | Bertagnolli | |
| 8,528,990 | B2 | 9/2013 | Latham | |
| 8,991,523 | B2 | 3/2015 | Shen et al. | |
| 2005/0098015 | A1 | 5/2005 | Latham | |
| 2007/0245866 | A1 * | 10/2007 | Wickman | B23B 27/065 82/1.11 |
| 2010/0043922 | A1 | 2/2010 | Leonardi et al. | |
| 2010/0194176 | A1 | 8/2010 | Lucek et al. | |
| 2014/0339879 | A1 | 11/2014 | Burton et al. | |
| 2015/0240635 | A1 | 8/2015 | Latchmann et al. | |

* cited by examiner

TAPERED CUTTER BIT AND MOUNTING BLOCK FOR THE SAME

CROSS-REFERENCE TO RELATED APPLICATION

This is a continuation-in-part application of application Ser. No. 15/196,957 filed Jun. 29, 2016; Ser. No. 15/196,957 application is a continuation of application Ser. No. 14/262,918 filed Apr. 28, 2014, which is a continuation-in-part of application Ser. No. 14/136,063 filed Dec. 20, 2013, all of the contents of which are hereby incorporated by reference.

BACKGROUND

This invention generally relates to the field of rotary driven cylindrical scarifiers for use in roadway surface milling. More particularly, the present invention is directed to wear resistant inserts on abrasive cutting elements for such rotary driven cylindrical scarifiers that may be used on equipment for modifying the surface of an existing road, and in particular, to equipment for smoothing areas of existing pavement by removing bumps, upward projections, and other surface irregularities, removing paint stripes, and milling shallow recessed to receive roadway edging and marking tape.

In general, roadway surface milling, planing, mining or reclaiming equipment disclosed in the prior art includes a rotary driven cylindrical comminuting drum which acts to scarify or mine the top portion of the asphaltic road surface in situ. Road planning machines are used to remove bumps and other irregularities on the surface of a road, runway, taxiway, or other stretch of pavement. This planning effect is typically achieved by grinding the paved surface so that the grinding depth may vary slightly, but the surface produced by the grinding unit is more level than the original surface. The road planning machine typically includes a grinding unit that is powered by an engine or motor. A tractor is attached to, or integral with, the grinding unit for propelling the grinding unit against the paved surface in a desired direction.

In some prior art devices of this type, a plurality of cutter bit support members are connected by bolts or by a weld to the curved surface of a drum or to flighting fixed to a drum surface. The plurality of the support members may be arranged end-to-end so as to form a more or less continuous helical pattern. The top surface of the helically arranged support members may be elevated above the curved surface of the drum. The top surfaces of the cutter bit support members may include angled openings into which conventional cutter bits are received. The cutter bits may be a conical cutter with preferably a tungsten carbide tip or the like. The tip may have a variety of shapes.

Examples of a cutter bit holder and drum are disclosed in U.S. Pat. Nos. 4,480,873; 5,052,757; 7,108,212; 7,290,726; and 7,338,134 to Latham where a rotatable drum has a generally cylindrical outer surface, and a plurality of blocks are mounted onto the outer surface of the drum. The blocks may be positioned onto the drum relative to one another such that the blocks define a helical flight extending around the outer surface of the drum, or may be spaced from each other in any desired pattern. Each of the blocks includes a first side wall, a second side wall, and a top surface. The first and second side walls are generally parallel to one another and generally perpendicular to the drum. The top surfaces of the blocks may define an outer periphery of the flight, if so arranged. Each of the blocks includes a slot and at least one pocket formed therein. The slot is generally rectangular and adapted to receive a tool holder. The slot includes first and second slot side walls, a bottom surface and a rear slot wall. The first and second slot side walls are generally parallel to one another and generally perpendicular to the rear slot wall. The rear slot wall may be oriented at an angle relative to the first and second side walls of the block. A generally rectangular shaped tool or tool holder is received within the slot of each block.

Each block also includes at least one pocket on one of the side walls of the slot. The pocket is generally circular and includes a generally cylindrically shaped retainer positioned therein. Each retainer includes a planar tapered surface that is parallel to and engages one side of the rectangular body of the tool or tool holder within the slot of the block to secure the tool holder in the slot. Each block includes a first hole extending from the second side wall to the rear slot wall. The first hole is oriented generally perpendicular to the rear slot wall. A threaded fastener extends through the hole and engages a threaded bore formed within the tool holder to further secure the tool holder within the slot of the block. Each pocket of each block includes a second hole extending from the pocket to the second side wall that may be oriented generally perpendicular to the second side wall. A threaded fastener may extend through the hole and engage a threaded bore formed within the retainer to pull the retainer within the pocket along a longitudinal axis of the second hole such that the planar tapered surface of the retainer pushes the tool holder against the rear slot wall and the side slot wall to keep the tool holder secured within the slot. This arrangement allows for easy quick replacement of the tool holder when the cutting element or tool held by the tool holder becomes worn or damaged.

More recently, it has been suggested that the cutting surfaces of the cutting tools used in the previously described blocks be formed of a diamond composition such as that disclosed in U.S. Pat. No. 8,501,144 to Bertagnolli. The diamond cutting surfaces may comprise diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. The diamond cutting surfaces thus formed exhibit extremely long life under the very abrasive environments encountered in roadway surface milling, planing, or reclaiming. The abrasive wear is such that the tool held by the tool holder may degrade from contact with the passing drift to such a point as to require replacement of the tool even though the cutting surface is still performing satisfactorily.

Thus, there exists a need in the art for an apparatus having a cutter bit insert for a milling drum, with or without flighting, that is capable of removable attachment to a drum and is resistant to wear, particularly when the cutting element is an extremely long-lasting diamond cutting surface. There is also a need for a cutter bit that may be quickly removed from the drum and replaced so that the down time experience during cutter bit replacement is minimized.

SUMMARY

A cutter bit of the present design may be used with a mounting block that may be adapted to be fixed onto a cutting drum for a scarifying milling machine. The cutter bit may take the form of an elongated body having an upper end including a cutting surface. An upper portion of the elongated body may be generally rectangular, or cylindrical, or other suitable shape. The cutter bit may have a lower end that may be shaped as shown in my earlier patents, for example, U.S. Pat. Nos. 4,480,873; 5,052,757; 7,108,212; and 7,338,134. A lower end of the cutter bit may also have a front surface having an optional lower planar tapered portion, and a back surface obverse to the front surface. The back surface may be planar over at least that portion obverse to the lower planar tapered portion. The cutter bit may include a wear resistant element replaceably mounted to the front surface of the elongated body immediately below the cutting surface. In one embodiment, the elongated body may comprise a hardened steel, while the cutting surface may comprise a diamond composition that may be fixed in a step adjacent the upper end of the elongated body. The cutting surface may comprise diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. The wear resistant element may comprise a carbide composition or a sintered diamond composition. The wear resistant element may have a variety of shapes and angular attitudes to deflect the passing drift away from the cutter bit body. The wear resistant element may be, for example, round, square, rectangular, trapezoidal or other shape, including an irregular shape that is best suited to the cutter bit elongated body or any inclination to which the cutter bit elongated body might be mounted in a mounting block.

In one embodiment, the cutter bit may include an opening through the elongated body immediately below the cutting surface from the front surface to the back surface of the elongated body. A stem may be received in the opening, the stem having a front end and a back end. The wear resistant element may be fixed to the front end of the stem. The wear resistant element may be replaced, when needed, by at least partially removing the stem from the opening and inserting a new stem having a new wear resistant element on the front end of the new stem. A fastener may be removably coupled to the back end of the stem to secure the stem in the opening. The opening receiving the stem may be perpendicular to the back surface of the elongated body. The elongated body may include an angled notch including a surface inclined with respect to the back surface of the stem. The opening receiving the stem may be perpendicular to the inclined surface of the angled notch.

In one embodiment, the cutter bit may include an opening through the elongated body immediately below the cutting surface from the front surface to the back surface of the elongated body. A stem may be received in the opening, the stem having a front end and a back end. A wear resistant element may be fixed to a nut that may be secured to the front end of the stem. The wear resistant element may be replaced, when needed, by loosening the stem from the combined nut and wear resistant element, substituting a new combined nut and wear resistant element, and re-tightening the stem into the new combined nut and wear resistant element.

In one embodiment, the mounting block may have a first side wall, a second side wall, and a top surface. The first and second side walls may be generally parallel to one another and generally perpendicular to the top surface. A slot may be positioned within a first side wall and extend through the top surface. The slot may be generally rectangular and include first and second slot side walls, a bottom surface and a rear slot wall. The first and second slot side walls may be generally parallel to one another and generally perpendicular to the rear slot wall so as to define a generally rectangular slot. The rear slot wall may be oriented at an angle relative to the first and second side walls of the mounting block so that the generally rectangular slot is at an angle. At least one pocket may situated within one of the first and second side walls to intercept the slot, and a retainer may be positioned within each pocket. Each retainer may include a planar laterally tapered surface designed to interact with a surface of the cutter bit elongated body, which may be dimensioned to be removably mounted within the slot. Optionally, the at least one pocket may be inclined with respect to the first and second side walls.

In one embodiment, the optional lower tapered portion of the cutter bit may include a pair of vertically spaced tapered portions, each tapered portion contacting the planar laterally tapered surface of one of the retainers. The rectangular elongated body portion of the cutter bit may also include an opening laterally aligned with respect to the cutting surface and adapted to receive a fastener coupling the elongated body portion to the slot back wall.

In one embodiment, the cutter bit lower portion may take a form similar to that shown in U.S. Pat. No. 7,300,115 to Holl et al. An upper portion may take the form of a generally rectangular elongated body having an upper end including a cutting surface. The cutter bit may also have a front surface and a back surface obverse to the front surface. The cutter bit may include a wear resistant element replaceably mounted to the front surface immediately below the cutting surface. The cutter bit body may comprise a hardened steel, the diamond cutting surface may be fixed in a step in the upper end of the cutter bit body, and the wear resistant element may comprise a carbide composition or a sintered diamond composition. The wear resistant element may have a variety of shapes and angular attitudes to deflect the passing drift away from the cutter bit body.

In one embodiment the cutting surface may have side edges that taper laterally outwardly toward the lower edge of the cutting surface that is adjacent to the wear resistant element. The laterally outwardly tapering edges of the cutting surface may assist in protecting the cutter bit body from wear caused by the passing drift. In one embodiment, the upper edge of the wear resistant element may be formed to closely conform to the shape of the adjacent lower edge of the cutting surface to inhibit wear of the cutter bit body between the cutting surface and the wear resistant element.

One feature of the apparatus is that the wear resistant element may be replaceably mounted to the front surface of the cutter bit immediately below the cutting surface. The feature has the advantage of permitting serial replacement of the wear resistant element without requiring that the cutter bit be removed for the mounting block holding the cutter bit, thereby lowering hardware replacement time and providing extended life for the cutter bit. Alternatively, in some circumstances, the wear resistant element may merely be rotated to a new orientation relative to the cutter bit thereby lowering hardware replacement costs.

Another feature of the apparatus is that the wear resistant elements may be provided with a variety of shapes and angular attitudes. This feature has the advantage of not merely resisting but also deflecting the passing drift away from the cutter bit body, thereby extending the life of the cutter bit body.

Another feature of the apparatus is that the mounting blocks may be secured to the cutter drum surface in a variety of patterns to define virtually any lacing pattern. The mounting blocks may be secured to the cutter drum in spaced relation to each other, or immediately adjacent to each other so as to define a flighting.

These and other features and their corresponding advantages of the disclosed combination will become readily apparent to those skilled in the art from the following detailed description of a preferred embodiment when considered in the light of the accompanying drawings.

DESCRIPTION OF PREFERRED EMBODIMENTS

Figure 1:
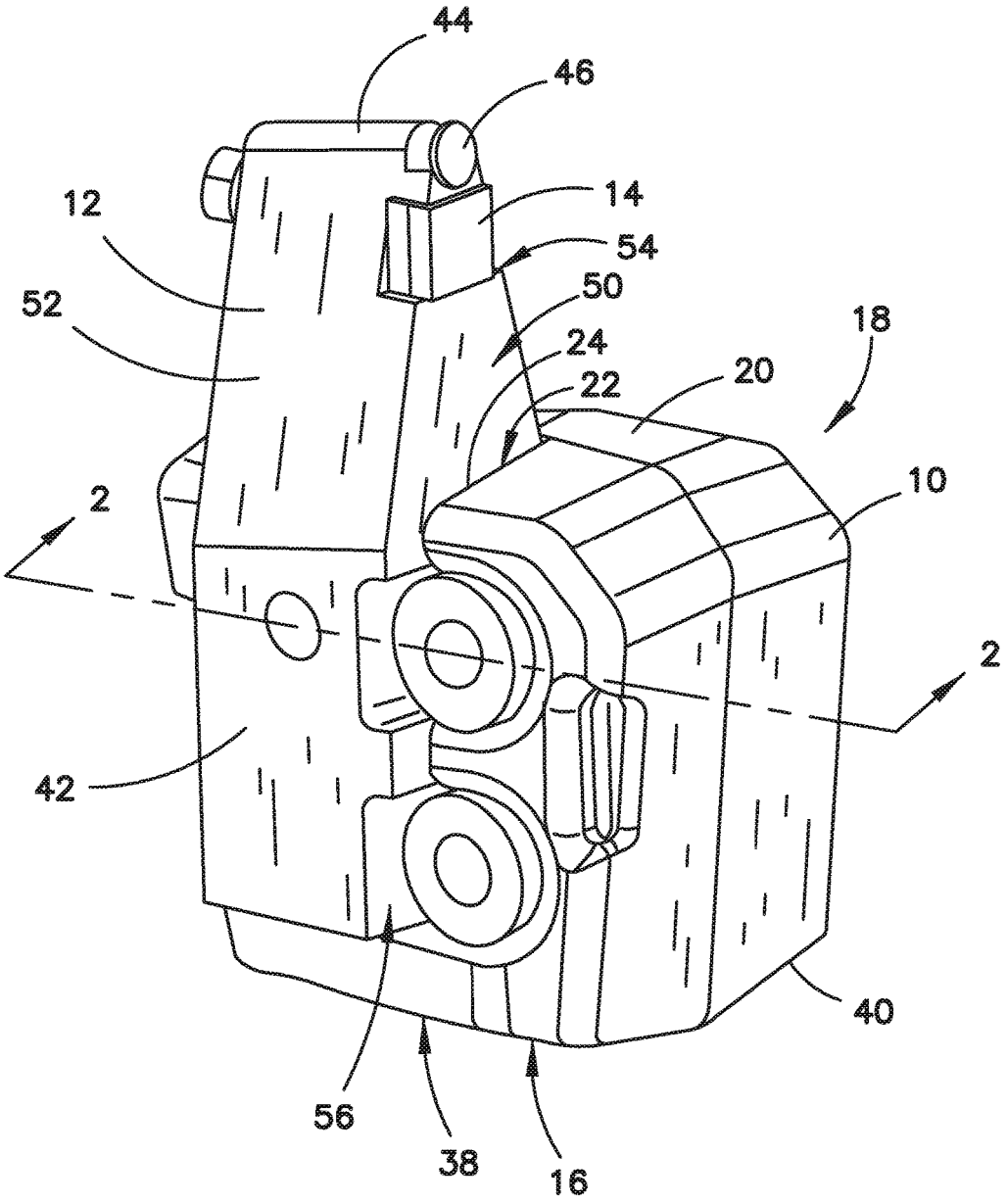
FIG. 1 is a perspective view of a mounting block holding a cutter bit having a replaceable wear resistant insert.
Figure 2:
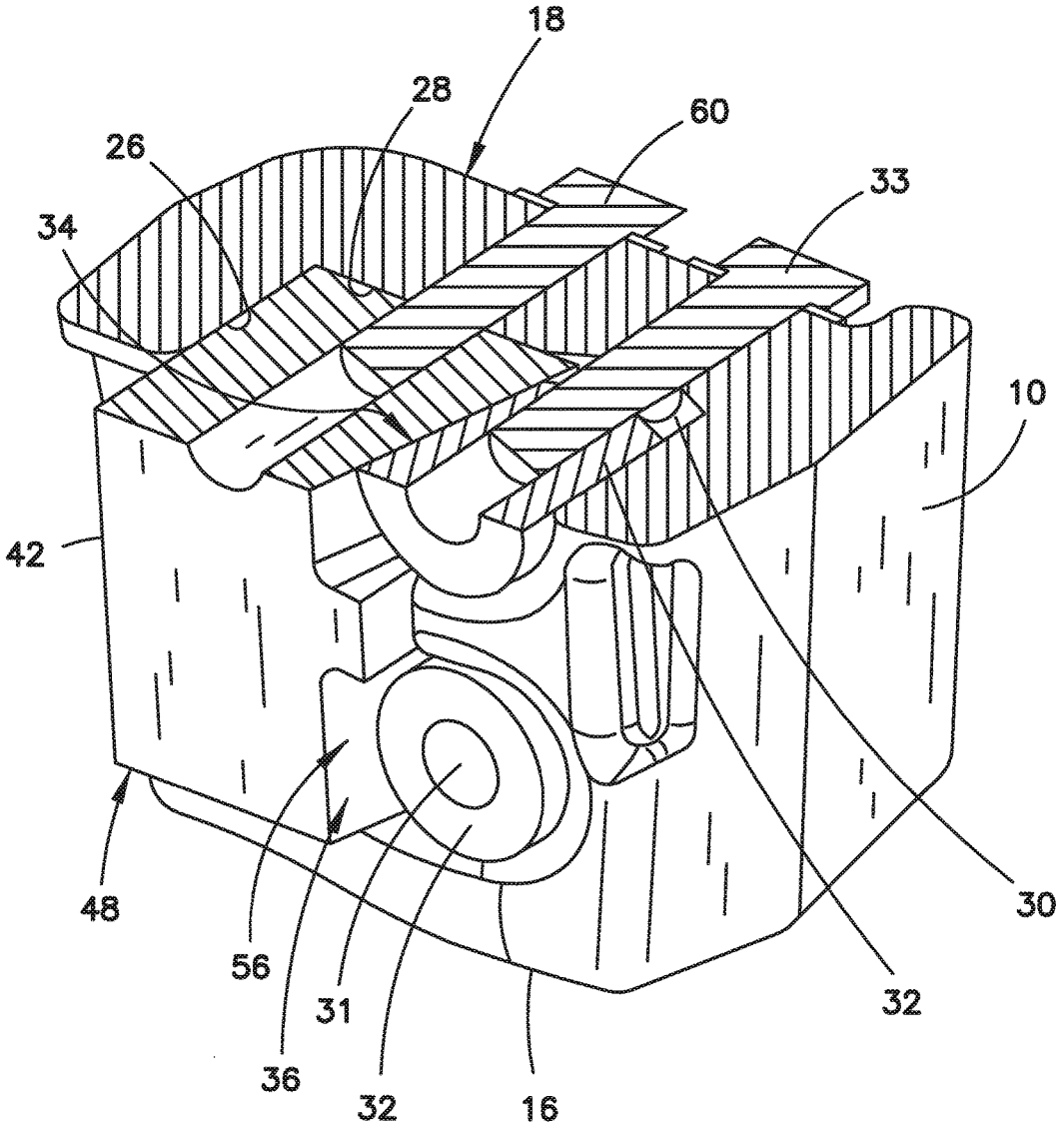
FIG. 2 is a perspective view taken with a top section removed along line 2-2 of FIG. 1.

With reference to all the drawings, the same reference numerals are generally used to identify like components. FIG. 1 is a perspective view of a mounting block 10 holding a cutter bit 12 having a replaceable wear resistant element 14. The mounting block 10 may have a first side wall 16, a second side wall 18, and a top surface 20. The first and second side walls 16, 18 may be generally parallel to one another, as shown in FIG. 2. The first and second side walls 16, 18 may be generally perpendicular to the top surface 20. A slot 22 may be positioned within the first side wall 16 and extend through the top surface 20. The slot 22 may be generally rectangular and include a first slot sidewall 24 and a second slot side wall 26, and a rear slot wall 28. The first and second slot side walls 24, 26 may be generally parallel to one another and generally perpendicular to the rear slot wall 28 so as to define a generally rectangular slot. The rear slot wall 28 may be parallel to or oriented at any angle relative to the first and second side walls 16, 18 of the mounting block 10 so that the generally rectangular slot 22 may be situated at any angle. At least one pocket 30 may situated within the first side wall 16 to intercept the slot 22. The least one pocket 30 may alternatively be situated within the second side wall 18 to intercept the slot 22. A retainer 32 may be positioned within each pocket 30. Each retainer 32 may include a planar laterally tapered surface 34 designed to interact with a surface 36 of the elongated body of the cutter bit 12. Each retainer 32 may include an opening 31 adapted to receive a suitable fastener 33 extending inward from the second side wall 18. The mounting block 10 may have a lower surface 38 having curvature suitable for mating with the surface of a rotatable drum or other working surface of a roadway surface milling, planing, or reclaiming machine or other equipment in a variety of patterns and alignments. The lower surface 38 may include a perimeter 40 adapted for welding attachment to the rotatable drum or other working surface.

In the embodiment of the cutter bit 12 shown in FIGS. 1-4, the cutter bit has a generally rectangular body 42 dimensioned to be removably mounted within the slot 22. The cutter bit may also have an upper end 44 including a cutting surface 46 situated contiguous to the upper end 44. The cutting surface 46 may be formed of a diamond composition and may have a variety of shapes. The diamond composition may be diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. The cutter bit 12 may also have a lower end 48, and a front surface 50. The front surface 50 may optionally have a lower planar tapered portion 56 that may be engaged by the laterally tapered surface 34 of each retainer 32 to secure the cutter bit 12 within the slot 22. A wear resistant element 14 may be replaceably mounted to the front surface 50 immediately below the cutting surface 46 and above the top surface 20 of the mounting block 10. The cutter bit 12 may have lateral tapered surfaces 52 extending from the upper end 44 down to the rectangular body 42. The wear resistant element 14 may be received in a slot 54 in the front surface 50, and may extend substantially entirely between the lateral tapered surfaces 52. The wear resistant element 14 may have a variety of shapes and angular attitudes to deflect the passing drift away from the cutter bit body. The vertical extent and shape of the wear resistant element 14 may be adapted as needed to protect the front surface 50 of the cutter bit 12 from excessive wear by contact with the abrasive drift removed from the surface being milled, preferably to a preferred side of the cutter bit 12.

Figure 3:
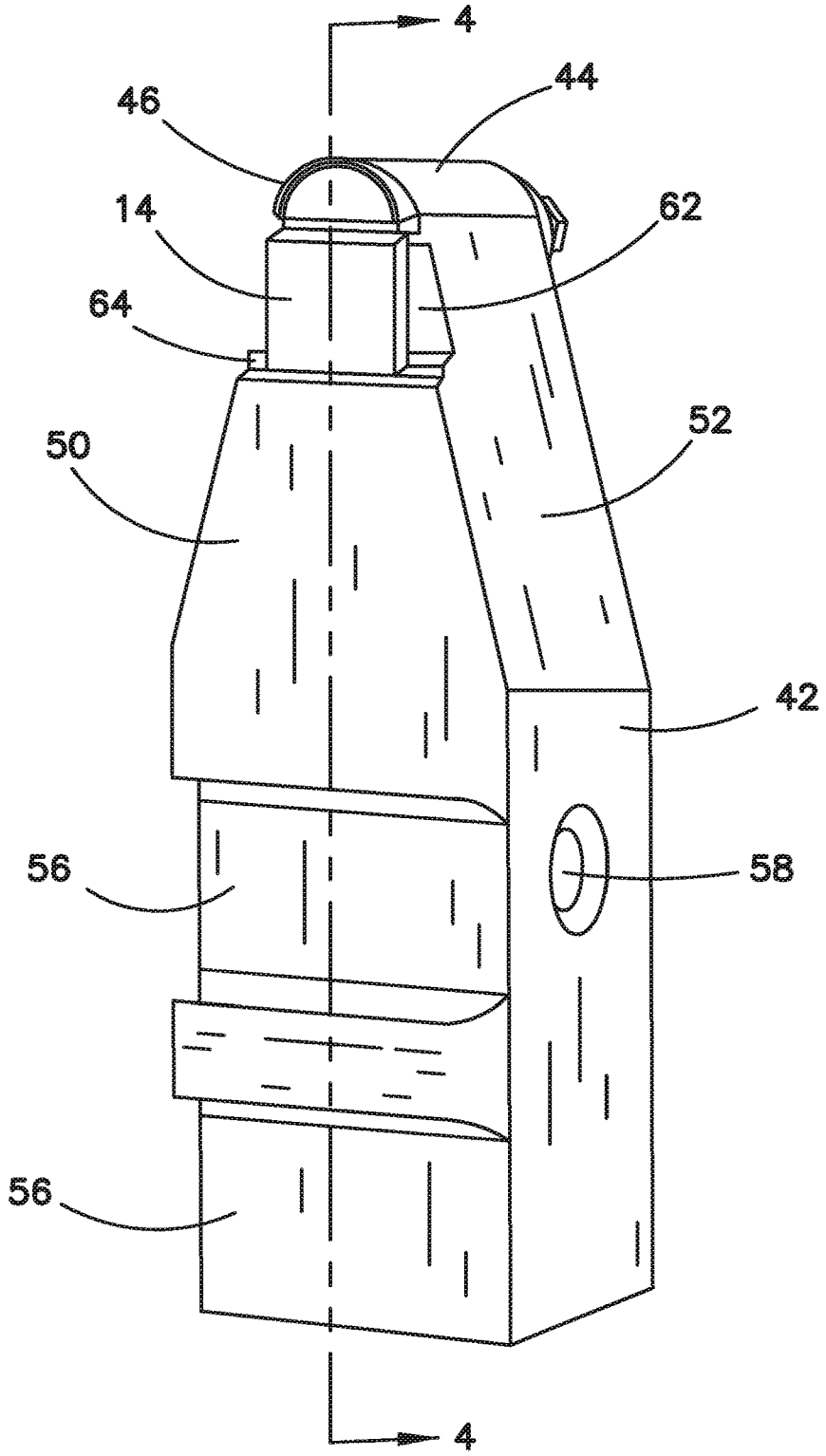
FIG. 3 is a perspective view of another cutter bit having a replaceable wear resistant insert.

As seen in FIGS. 2 and 3, the front surface 50 of the cutter bit 12 may include a pair of vertically spaced tapered portions 56, each tapered portion being dimensioned to be contacted by the planar laterally tapered surface 34 of one of the retainers 32. While FIG. 2 shows the retainer 32 being pulled by fastener 33 into the contacting relationship with the tapered portion 56, the tapered portions 56 of the cutter bit 12 may be omitted. Where the front surface 50 has no tapered portions 56, the pocket 30 and the opening for the fastener 33 may be inclined with respect to the front surface 50 of the cutter bit, so that the laterally tapered surface 34 of the retainer 32 contacts the front surface 50. The rectangular elongated body portion 42 of the cutter bit may also include an opening 58 laterally aligned with respect to the cutting surface 46 and adapted to receive a fastener 60 extending inward from the second sidewall 18 to couple the elongated body portion 42 to the slot rear wall 28. In the event that the cutter bit 12 as a whole needs replaced, the fasteners 33 may be removed from the openings 31 in each retainer 32. The fastener 60 may be removed from opening 58 and the cutting bit 12 laterally removed from the holding block 10. The cutter bit 12 and the holding block 10 may have a variety of shapes and sizes, and may be mounted to a working surface of a variety of roadway surface milling, planing, mining or reclaiming machines and equipment in a variety of patterns and alignments.

Figure 4:
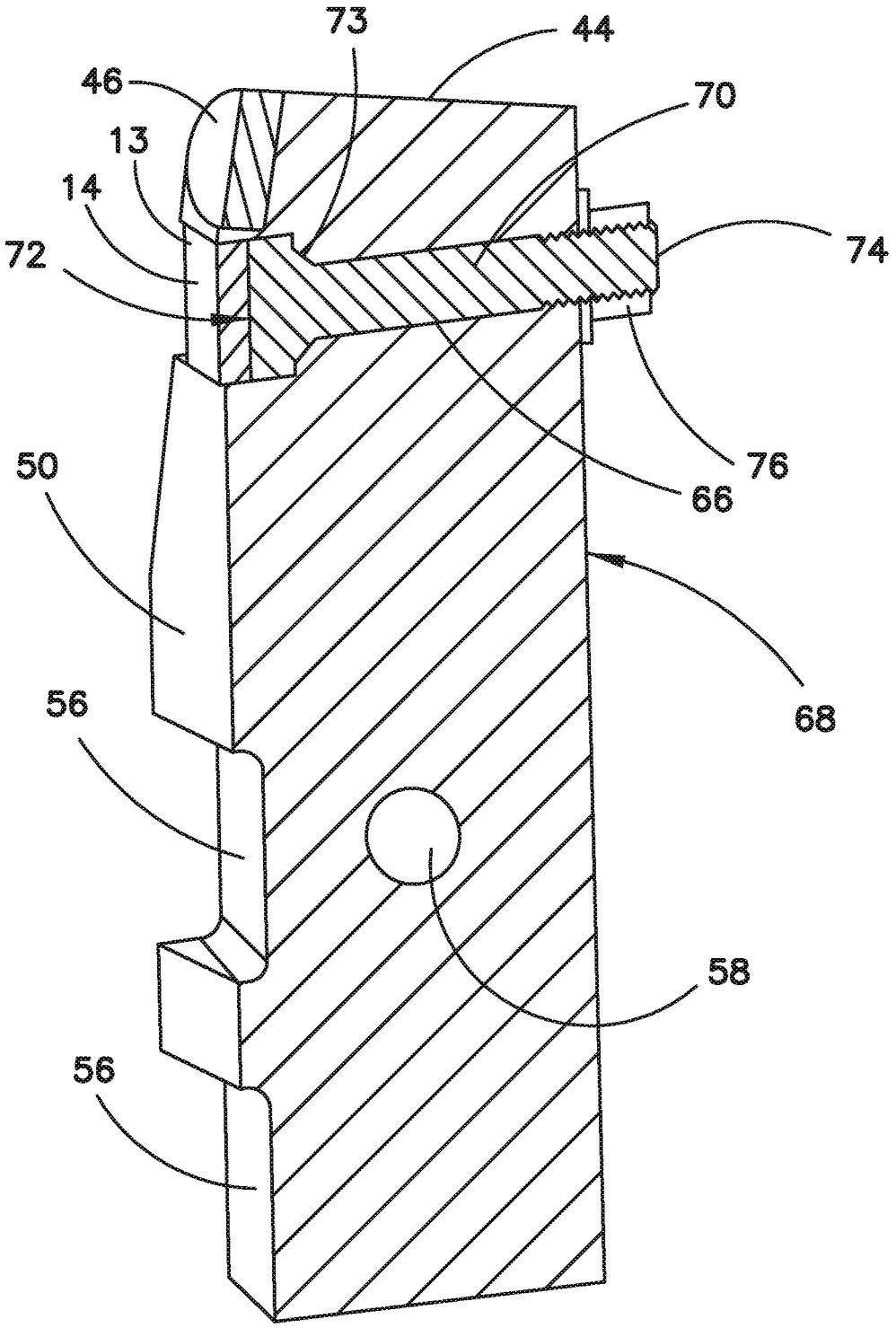
FIG. 4 is vertical sectional view of the cutter bit shown in FIG. 1.

As seen in FIGS. 1, 3, and 4, the cutting surface 46 may have a variety of shapes and sizes. In a preferred embodiment the cutting surface 46 comprises a diamond composition fixed in a step 62 in the upper end 44 of the cutter bit 12. The elongated body 42 of the cutter bit is typically formed of a hardened steel, while the wear resistant element 14 preferably comprises a carbide composition that significantly resists wear from the passing abrasive drift removed from the surface being milled. As seen if FIG. 3, both the cutting surface 46 and the surface of the wear resistant element 14 may be recessed from the front surface 50 of the cutter bit 12 by a further step 64.

FIG. 4 is a vertical sectional view of the cutter bit 12 shown in FIG. 1, but is representative of a preferred mounting for the wear resistant element 14. The cutter bit 12 may include an opening 66 through the elongated body 42 immediately below the cutting surface 46 from the front surface 50 to the back surface 68 of the elongated body. A stem 70 having a front end 72 and a back end 74 may be received in the opening 66. The wear resistant element 14 may be fixed to the front end 72 of the stem 70. A fastener 76 may be removably coupled to the back end 74 of the stem 70 to secure the stem in the opening 66. The stem 70 may include a tapered portion 73 which may act to ensure the proper positioning of the wear resistant element 14. Depending on the configuration of a front surface 13 of the wear resistant element 14, the wear resistant element 14 may be rotated from time to time to lengthen the life of the wear resistant element 14. The wear resistant element 14 may be replaced, when needed, by removing the fastener 76 from the stem 70, and forcing the stem 70 from the opening 66, typically by a moderate tap from a hammer or the like. A new stem 70 having a new wear resistant element 14 on the front end 72 may then be inserted in the opening 66 and secured in place by fastener 76. This arrangement permits serial replacement of the wear resistant element 14 without requiring that the cutter bit 12 be removed for the mounting block 10 holding the cutter bit, thereby lowering hardware replacement time and providing extended life for the cutter bit 12.

Figure 5:
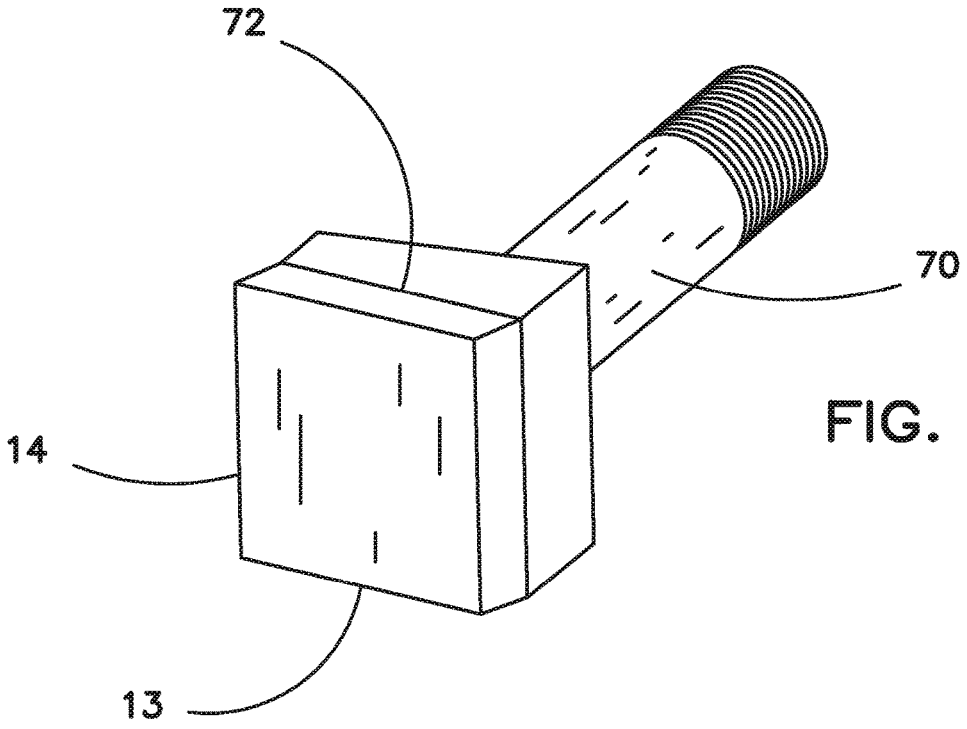
FIG. 5 is a perspective view of a replaceable wear resistant insert having an inclined front face.
Figure 6:
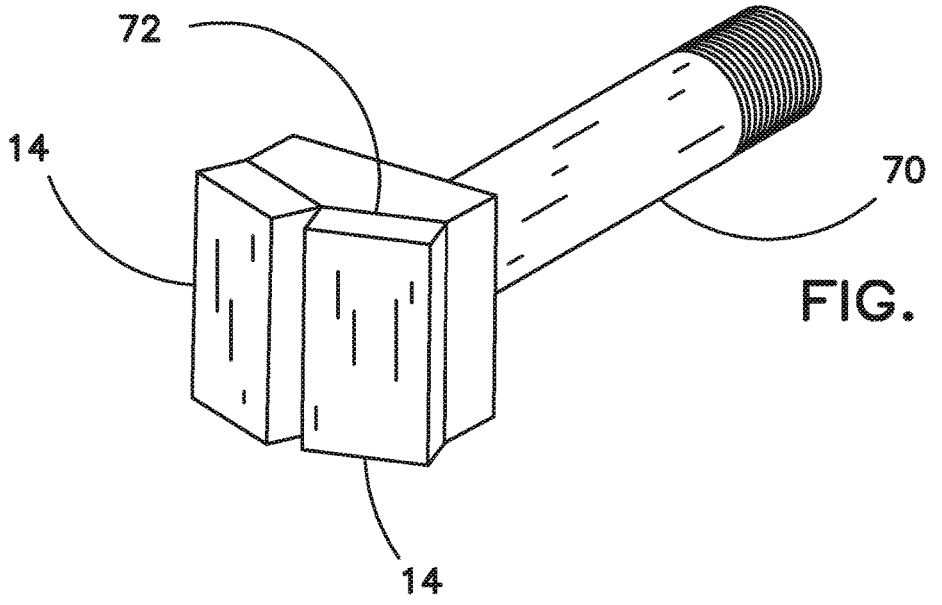
FIG. 6 is a perspective view of a replaceable wear resistant insert having a dual inclined front face.
Figure 7:
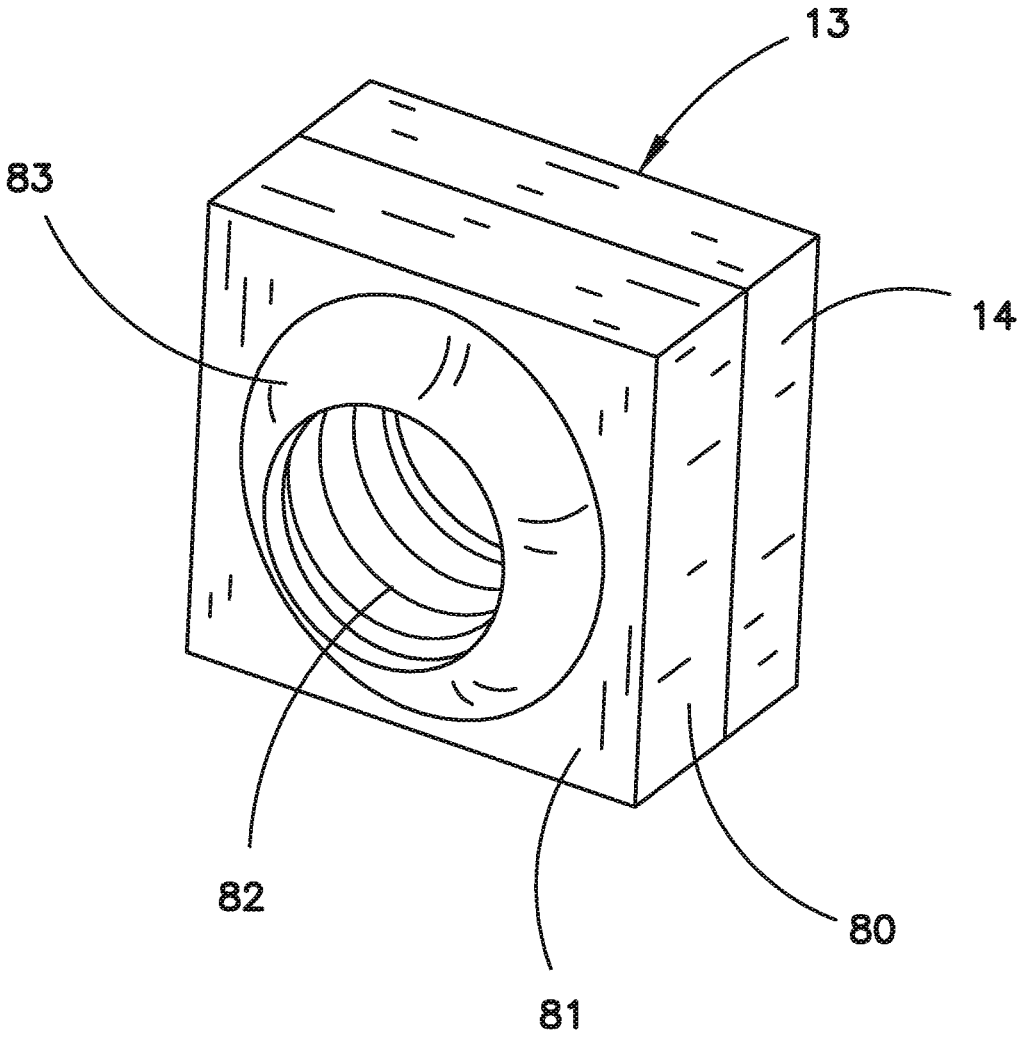
FIG. 7 is a perspective view of a replaceable wear resistant insert formed as a nut to be secured to cutter bit mounting block by a separate fastener.

FIGS. 5-7 show some examples of variations in wear resistant elements 14 that may be formed to be coupled to any of the cutter bits 12 illustrated herein, as well as other non-illustrated cutter bits, so as to protect the front surface 50 of the cutter bit 12 from excessive wear by contact with the abrasive drift removed from the surface being milled. As shown in FIG. 5, the front end 72 of the stem 70 may be inclined with respect to a surface perpendicular to the stem 70. The wear resistant element 14 may be fixed to the front end 72 of the stem 70 so that the front surface 13 of the wear resistant element is also inclined with respect to the stem 70. The wear resistant element 14 shown in FIG. 5 may be inserted into an opening 66 of any cutter bit 12 so that the front surface 13 is inclined to either side of the cutter bit, or upward or downward so as to deflect the passing drift away from the cutter bit body, thereby extending the life of the cutter bit body.

The front end 72 of the stem 70 may also be doubly inclined with respect to a surface perpendicular to the stem 70 as shown in FIG. 6. Wear resistant elements 14 may be fixed to the front end 72 of the stem 70 so that the front surfaces 13 of the wear resistant elements are also inclined with respect to the stem 70. The wear resistant elements 14 shown in FIG. 6 may be inserted into an opening 66 of any cutter bit 12 so that the front surfaces 13 are inclined to deflect the passing drift to both sides of the cutter bit body, thereby extending the life of the cutter bit body. While FIGS. 6 and 7 have shown two particularly useful shapes and angular attitudes for the wear resistant elements 14, other useful shapes will be apparent to those skilled in the art.

FIG. 7 shows an alternate arrangement for a wear resistant element 14 wherein the wear resistant element 14 may be fixed to a nut 80 having a treaded interior surface 82 that may be secured to a bolt or other threaded fastener that may be inserted into the opening 66 from the back surface 68 of the elongated body shown in FIG. 4. The back surface 81 of the nut 80 may include a tapered portion 83 to help center and lock the nut 80 within the step 62 below the diamond cutting surface 46. The combined nut 80 and wear resistant element 14 may be rotated an necessary to preserve the life of the wear resistant element 14. The wear resistant element 14 may be replaced, when needed, by loosening the bolt from the combined nut 80 and wear resistant element 14, substituting a new combined nut 80 and wear resistant element 14, and re-tightening the bolt into the new combined nut and wear resistant element. The front surface 13 of the combined nut 80 and wear resistant element 14 may have a variety of useful shapes and angular attitudes, including those useful shapes and angular attitudes shown in FIGS. 5 and 6.

Figure 8:
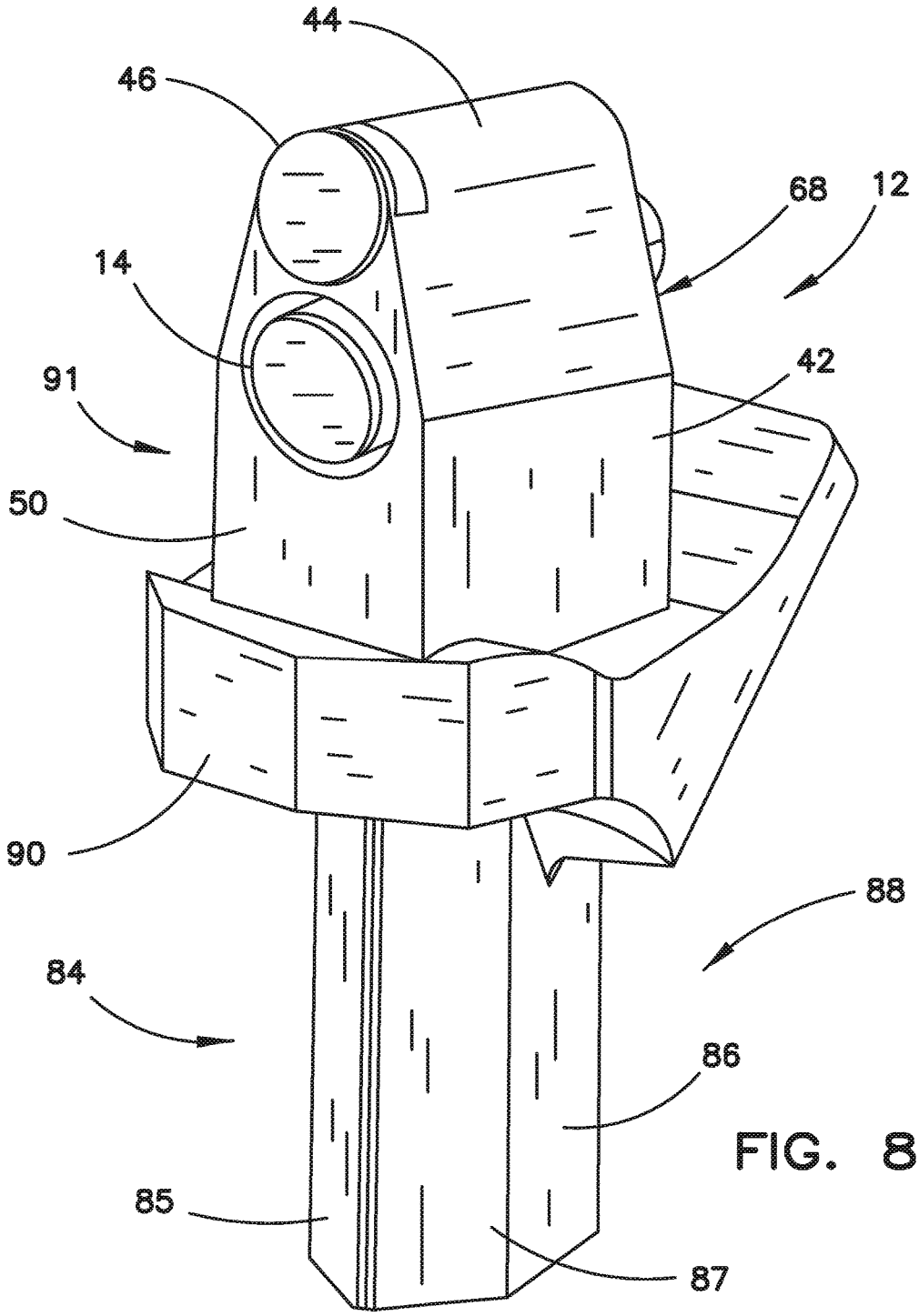
FIG. 8 is a perspective view of another cutter bit having a replaceable wear resistant insert.

FIG. 8 shows another cutter bit 12 having a replaceable wear resistant insert 14. A lower portion 84 of the cutter bit 12 may take a form similar to that shown in U.S. Pat. No. 7,300,115 to Holl et al., including a stem 86 designed to be received into a suitable mounting block, not shown. The stem 86 may include spaced tapered portions 85, 87 on a forward surface of the stem, and a clamping face 88 on a rearward surface of the stem, which act to ensure alignment of the cutter 12 in a desired direction with respect to the mounting block in which the stem 86 is received. A plate 90 may be provided at an upper end of the stem 86. An upper portion 91 may be fixed to an upper surface of the plate 90, and may take the form of a generally elongated body 42 having an upper end 44 including a cutting surface 46. The stem 86 including the spaced tapered portions 85, 87 may be directed to ensure a desired rake angle of the diamond cutting surface 46 and to ensure the top surface 44 is parallel to the center line of the drum forming the working surface. The cutter bit upper portion 91 may also have a front surface 50 and a back surface 68 obverse to the front surface 50. The cutter bit upper portion 91 may include a wear resistant element 14 replaceably mounted to the front surface 50 immediately below the cutting surface 46. The cutter bit body 42, stem 86, and plate 90 may comprise a hardened steel. The cutting surface 46 may comprise a diamond composition which may be fixed in the step 62 adjacent the upper end 44 of the cutter bit body 42. The wear resistant element 14 may comprise a carbide composition or a sintered diamond composition. The wear resistant element 14 may have a variety of shapes and angular attitudes, including those illustrated in FIGS. 1, 3, and 4-8, to deflect the passing drift away from the cutter bit body 42. The wear resistant element 14 may additionally have a variety of other shapes including, for example, round, square, rectangular, trapezoidal or other shape, including an irregular shape that is best suited to the shape of the cutter bit elongated body 42 or any inclination to which the cutter bit elongated body might be mounted in a mounting block.

Figure 9:
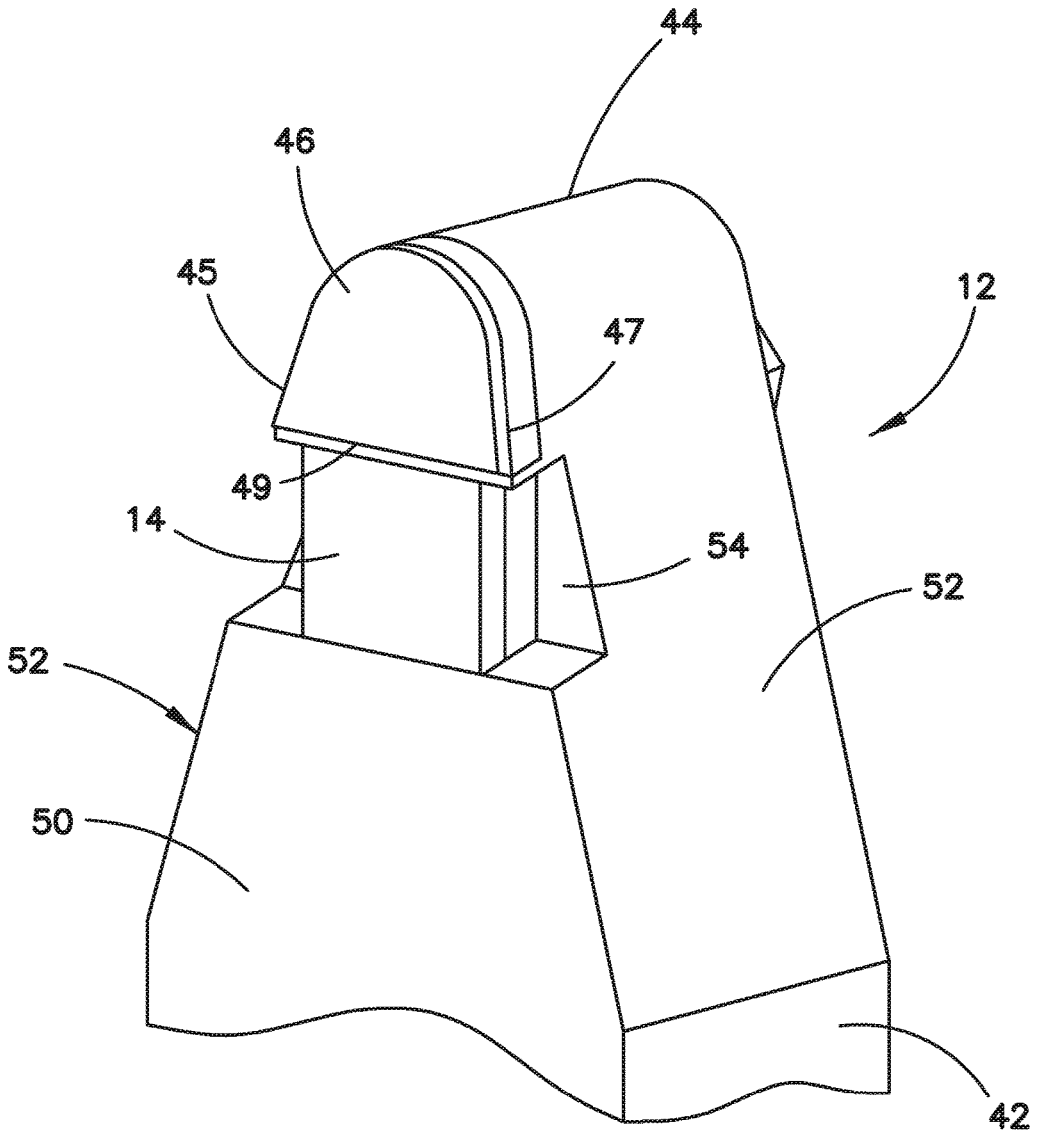
FIG. 9 is a perspective view of another cutter bit having a replaceable wear resistant insert and a cutting surface having laterally outwardly tapering side edges.

In the embodiment of the cutter bit 12 shown in FIG. 9, the cutter bit has a generally rectangular body 42. The cutter bit 12 may also have an upper end 44 including a cutting surface 46 situated contiguous to the upper end 44. The cutting surface 46 may be formed of a diamond composition and may have side edges 45 and 47 that taper laterally outwardly toward a lower edge 49 adjacent to the wear resistant element 14. The laterally outwardly tapering edges 45 and 47 of the cutting surface 46 may assist in protecting the cutter bit 12 from wear caused by passing drift. The diamond composition forming the cutting surface 46 may be diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. The cutter bit 12 may also have a lower end 48 that may be configured variously such as shown in FIG. 3 or FIG. 8. The cutter bit 12 may have a front surface 50. A wear resistant element 14 may be replaceably mounted to the front surface 50 immediately below the lower edge 49 of the cutting surface 46. The cutter bit 12 may have lateral tapered surfaces 52 extending from the upper end 44 down to the rectangular body 42. The wear resistant element 14 may be received in a slot 54 in the front surface 50, and may extend substantially entirely between the lateral tapered surfaces 52. The wear resistant element 14 may have a variety of shapes and angular attitudes to deflect the passing drift away from the cutter bit body as shown, for example, in FIGS. 5 and 6. The vertical extent and shape of the wear resistant element 14 may be adapted as needed to protect the front surface 50 of the cutter bit 12 from excessive wear by contact with the abrasive drift removed from the surface being milled, preferably to a preferred side of the cutter bit 12.

Figure 10:
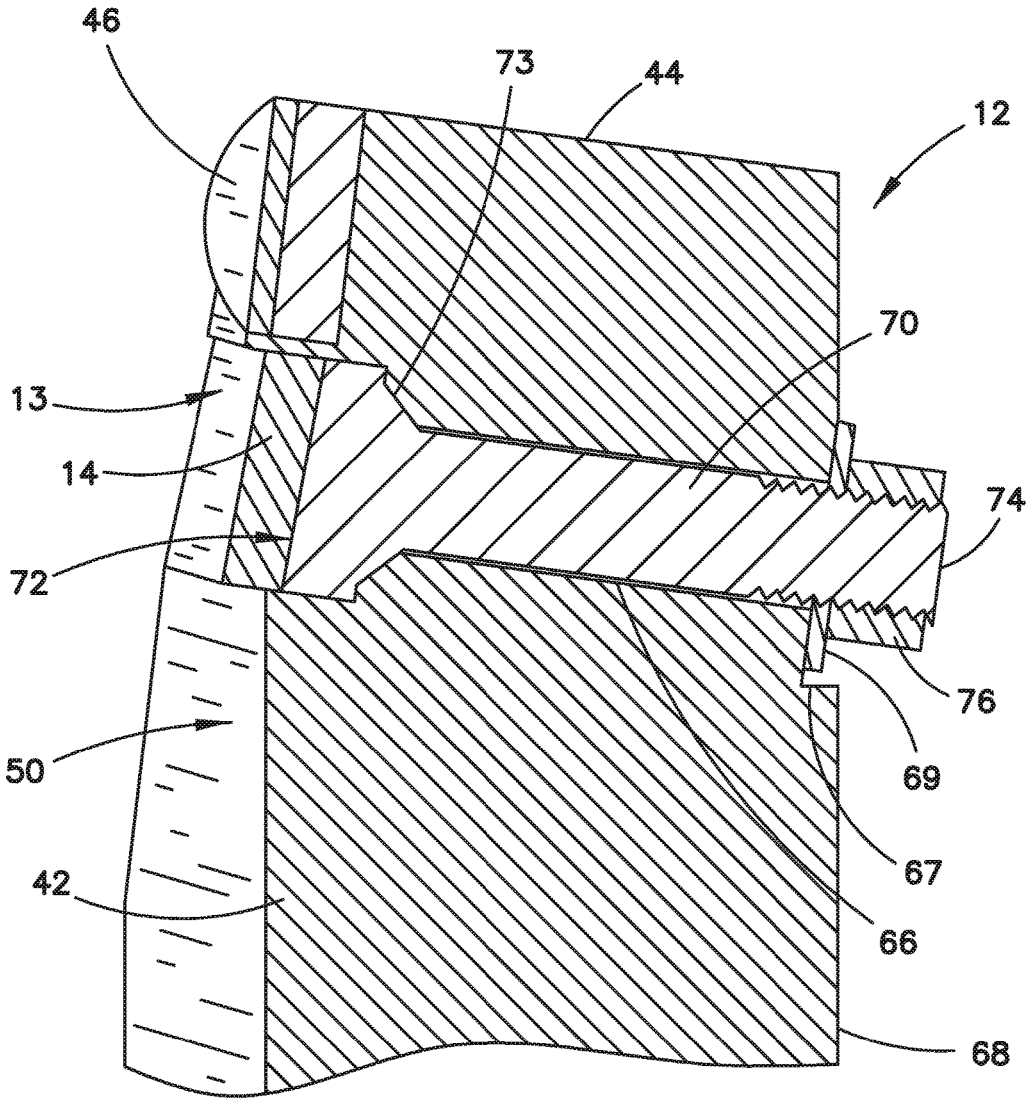
FIG. 10 is a sectional view, somewhat similar to FIG. 4, of an upper portion of another cutter bit including an angled notch having a surface inclined with respect to the back surface of the stem.

FIG. 10 is a vertical sectional view of another cutter bit 12 showing another preferred mounting for the wear resistant element 14. The cutter bit 12 may include an opening 66 through the elongated body 42 immediately below the cutting surface 46 from the front surface 50 to the back surface 68 of the elongated body 42. The back surface 68, which may be generally parallel to the front surface 50 may include an angled notch 67 including a surface 69 inclined with respect to the back surface 68 of the body 42. The opening 66 may be perpendicular to the back surface 68 of the body 42 as shown in FIG. 4. Alternatively, the opening 66 may be perpendicular to the inclined surface 69 of the angled notch 67. A stem 70 having a front end 72 and a back end 74 may be received in the opening 66. The wear resistant element 14 may be fixed to the front end 72 of the stem 70. A fastener 76 may be removably coupled to the back end 74 of the stem 70 to secure the stem in the opening 66. The stem 70 may include a tapered portion 73 which may act to ensure the proper positioning of the wear resistant element 14. Depending on the configuration of the front surface 13 of the wear resistant element, the wear resistant element may be rotated from time to time to lengthen the life of the wear resistant element 14. The wear resistant element 14 may be replaced, when needed, by removing the fastener 76 from the stem 70, and forcing the stem 70 from the opening 66, typically by a moderate tap from a hammer or the like. A new stem 70 having a new wear resistant element 14 on the front end 72 may then be inserted in the opening 66 and secured in place by fastener 76. This arrangement permits serial replacement of the wear resistant element 14 without requiring that the cutter bit 12 be removed for the mounting block 10 holding the cutter bit, thereby lowering hardware replacement time and providing extended life for the cutter bit 12.

Figure 11:
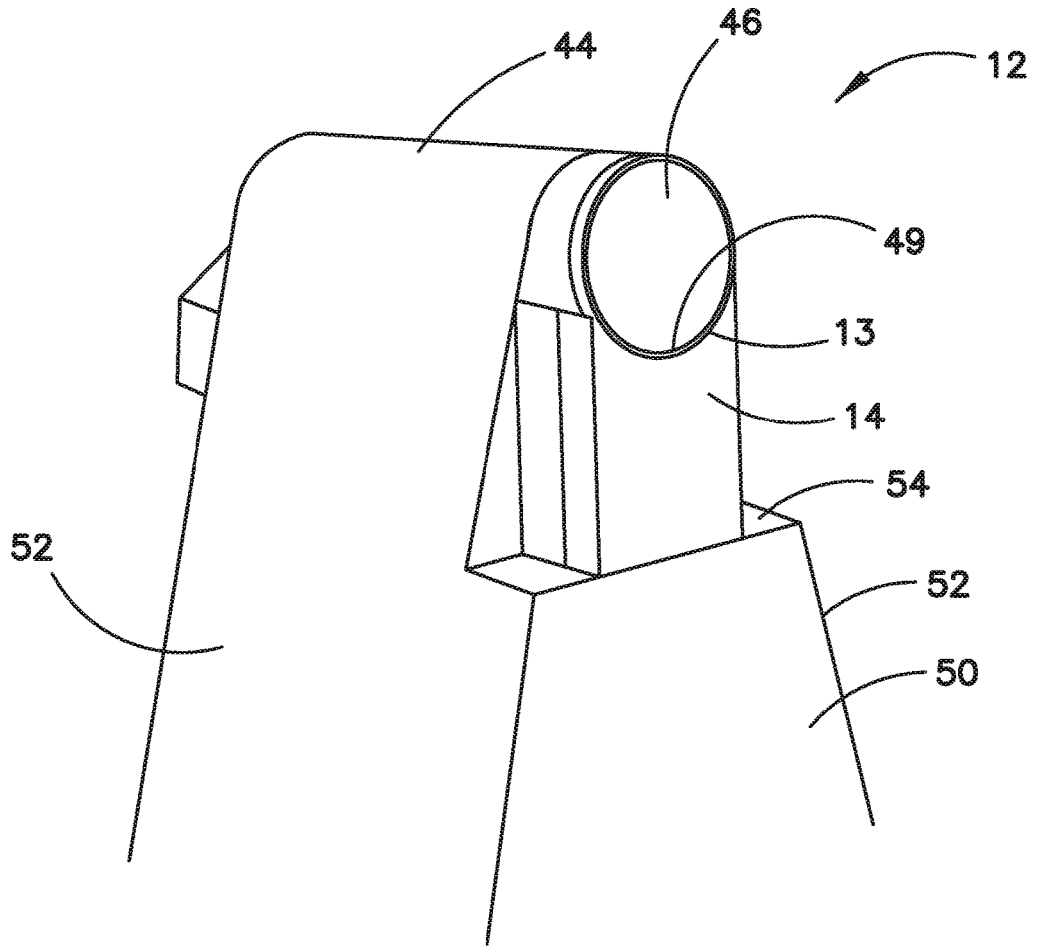
FIG. 11 is a perspective view of an upper portion of another cutter bit where the upper edge of the wear resistant element is formed to closely conform to the shape of the adjacent lower edge of the cutting surface.

In the embodiment of the cutter bit 12 shown in FIG. 11, the cutter bit may have an upper end 44 including a cutting surface 46 situated contiguous to the upper end 44. The cutting surface 46 may be formed of a diamond composition and may have a variety of shapes. A wear resistant element 14 may be replaceably mounted to the front surface 50 immediately below the cutting surface 46. The vertical and horizontal extent and shape of the wear resistant element 14 may be adapted as needed to protect the front surface 50 of the cutter bit 12 from excessive wear by contact with the abrasive drift removed from the surface being milled. The wear resistant element 14 may have the front surface 13 include an upper edge that is formed to closely conform to the shape of the adjacent lower edge 49 of the cutting surface 46, may be received in a slot 54 in the front surface 50, and may extend substantially entirely between the lateral tapered surfaces 52. The wear resistant element 14 may have a variety of angular attitudes to deflect the passing drift away from the cutter bit body.

Figure 12:
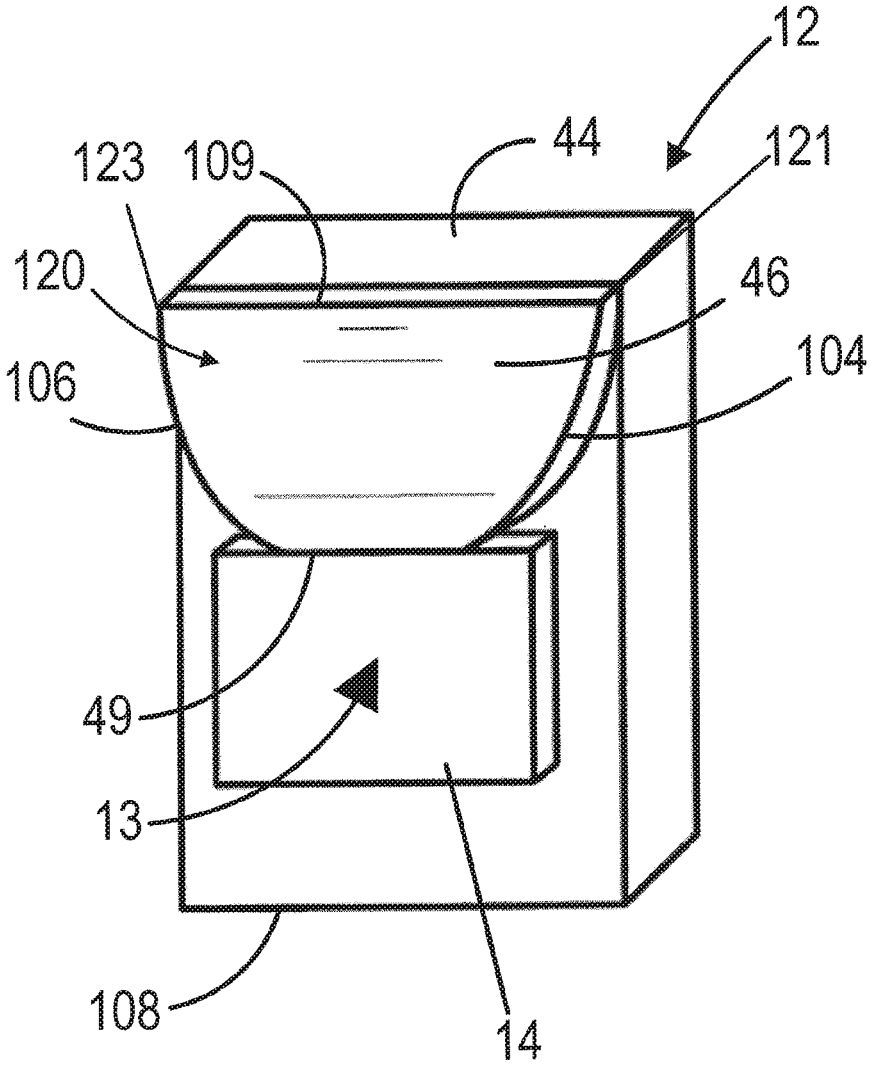
FIG. 12 is an isometric view of an example cutter bit.
Figure 14:
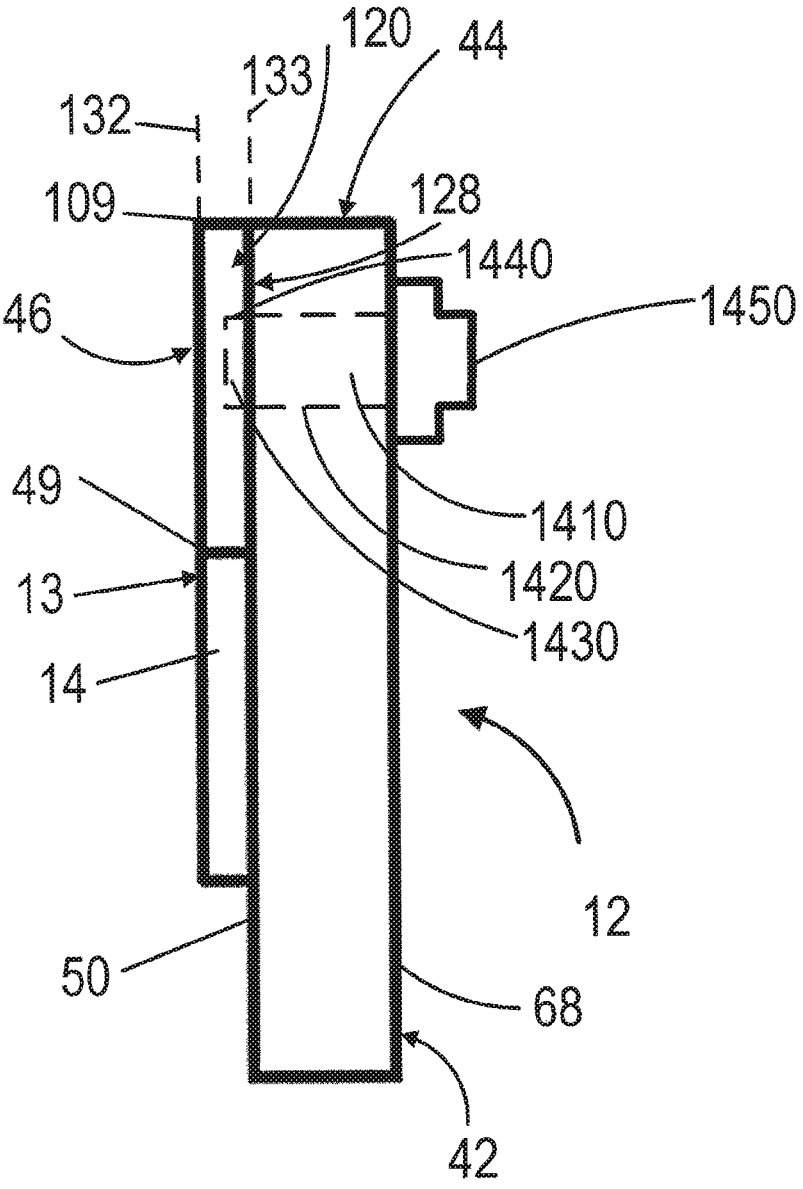
FIG. 14 is a side view of an example cutter bit.

FIG. 12 shows an example of the cutter bit 12. The cutter bit 12 may have a cutter element 120. The example cutter elements 120 described herein are applicable to all example cutter bits 12 described. The cutter element 120 may be an element independently fixed to the front surface 50 of the cutter bit 12 at the upper end 44, such as by brazing a planar front surface 50 of the cutter bit 12 to a planar back surface 128 of the cutter element 120 as shown in FIG. 14. The planar back surface 128 may be obverse to the front surface 50 of the elongated body 42.

The cutting element 120 may include a diamond composition and may have a variety of shapes. The diamond composition may be diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. All examples of the cutter bit 12 including cutter element 120 described herein may include the diamond composition unless otherwise indicated.

The cutting surface 46 may have peripheral edges including an upper cutting edge 109, a lower edge 49, and side edges 104 and 106. Each of the edges 109, 49, 104, and 106 may form a peripheral edge of the cutting surface 46. Alternatively or in addition, the cutter bit 12 may include the lower end 48 forming a bottom edge 108. The bottom edge 108 may be an edge of the cutter bit 12 located on the front surface 50, opposite the upper end 44.

Alternatively or in addition, the cutter element 120 may be independently fixed to the front surface 50 of the cutter bit 12 by welding the planar front surface 50 of the cutter bit 12 to the planar back surface 128 of the cutter element 120. In other examples the cutter element 120 may be affixed to the front surface 50 via a bolt 1410 or other threaded fastener as shown in FIG. 14. For example, the cutter element 120 may be fixed to the bolt 1410 or other threaded fastener. The bolt 1410 may include a threaded interior surface 1420 secured to the bolt 1410. The bolt 1410, having the cutter element 120 affixed thereto, may extend through the cutter bit 12 and out the back surface 68. A nut 1450 may secure the bolt 1410 in place. As a result of the bolt 1410 being secured, the cutter element 120 may also be secured in a predetermined position that aligns the upper cutting edge 109 with the upper end 44.

Alternatively or in addition, the back surface 128 of the cutter element 120 may have a cavity 1430 formed to receive the bolt 1410, as shown in FIG. 14. The cavity 1430 may include a threaded interior surface 1440 such that the threading of the bolt 1410 may engage the threading of the cavity 1430. As a result of the bolt 1410 inserted into the cavity 1430, the cutter element 120 may be secured in place such that the upper cutting edge 109 is aligned with the upper end 44 in the predetermined position.

The upper cutting edge 109 may be aligned to the upper end 44 in a predetermined position. The alignment of the upper cutting edge 109 and the upper end 44 allows for consistent cutting and/or grinding of a working surface during operation of the cutter bit 12. The upper cutting edge 109 may be parallel to the lower edge 49. Alternatively or in addition, the upper cutting edge 109 may be parallel with a bottom edge 108. Alternatively or in addition, the upper cutting edge 109 may be parallel with both lower edge 49 and the bottom edge 108. Alternatively or in addition, the lower edge 49 may be parallel with the bottom edge 108. The upper cutting edge 109 may include a first end 121 and a second end 123. The upper cutting edge 109 may be aligned on the front surface 50 to be substantially parallel with a portion of the working surface of a rotatable drum or other working surface upon which the cutter bit 12 may be positioned. In some examples, the first end 121 of the upper cutting edge 109 may be included in a plane parallel to the portion of the working surface and the second end 123 may be radially positioned as much as +/−10 thousandths of an inch (0.254 mm) from the plane parallel to the working surface including the first end 121. Thus, as described herein, the term substantially parallel is within +/−10 thousandths of an inch (0.254 mm). In some examples, the upper cutting edge 109 may have a length between 0 and 3 inches (76.2 mm), including 3 inches (76.2 mm).

Figure 16:
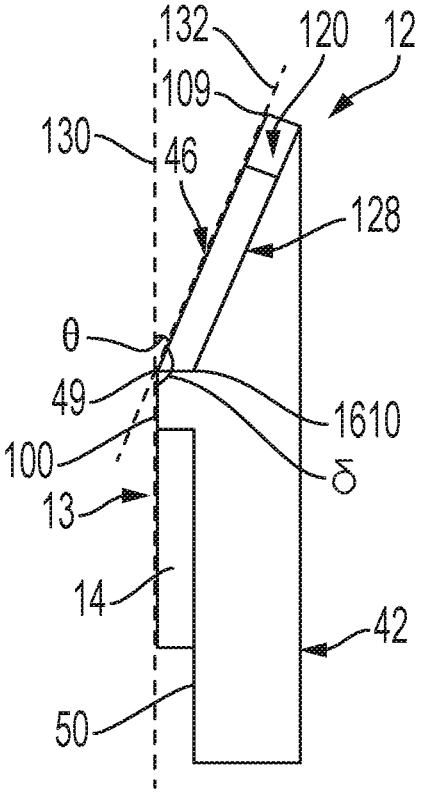
FIG. 16 is a side view of an example cutter bit having a cutter element with a linear lower edge, a rake angle, and a partition separating a wear resistant element from the cutter element.

The lower edge 49 may be linear and abut adjacent features such as, for example, the wear resistant element 14 or a partition, such as, for example, the partition 100 shown in FIG. 16, thus positioning the cutter element 120 to align the upper cutting edge 109 with the upper end 44. The lower edge 49 may inhibit rocking or movement of the cutter element 120 during installation of the cutter bit 120 onto the cutter bit 12, and align the cutter element 120 in a predetermined position on the front face 50 so that the upper end 44 is aligned substantially parallel with the upper cutting edge 109 and/or the working surface. In addition, the lower edge 49 may inhibit rocking or movement of the cutter element 120 during operation of the cutter bit 12 to maintain alignment of the upper end 44 with the upper cutting edge 109 in the predetermined position such that the upper cutting edge 109 is substantially aligned in parallel with the working surface.

The lower edge 49 may be a peripheral edge of the cutting surface 46 nearest to the bottom edge 108. The lower edge 49 may be positioned abutting an adjacent feature such as the wear resistant element 14 or the partition 100 so that the cutter element 120 is aligned in the predetermined position. The lower edge 49 has a length sufficient to inhibit rotation of the cutting surface 46 and is linear. The linear nature of the lower edge 49 aligns the upper end 44 and the upper cutting edge 109 substantially parallel by inhibiting the rotation and/or movement of the cutter element 120 during operation of the cutter bit 12 and/or installation of the cutter bit 12. The lower edge 49 may abut and/or be fixedly coupled to an adjacent feature of the cutter element 120, such as the wear resistant element 14 or the partition 100. For example, the lower edge 49 may be welded or brazed to the wear resistant element 14 or the partition 100. Fixedly coupling the lower edge 49 to the wear resistant element 14 or partition 100 assists with aligning the upper cutting edge 109 with the upper end 44 both during installation of the cutter element 120 and during operation of the cutter bit 12. In some examples, the length of the lower edge 49 may be at least 5 thousandths of an inch (0.127 mm). Alternatively or in addition, a length of the upper cutting edge 109 to a length of the lower edge 49 may be a predetermined ratio. In some examples, a partition 100 may be positioned on the front face 50 below the wear resistant element 14 to align the cutter element 120 in the predetermined position when the cutter element 120 is positioned to abut the wear resistance element 14. In other examples, the front face 50 of the cutter element 50 may form a slot in which the cutter element 120 is positioned such that the cutter element 120 is aligned in the predetermined position and the upper cutting edge 109 is substantially parallel with the working surface. In these examples, the lower edge 49 of the cutter element 120 abuts a partition, a shelf, or shoulder formed in the front face 50 as described later (see FIG. 17) to achieve the predetermined position and align upper cutting edge 109 substantially parallel with at least one of the upper end 44, the bottom edge 108, or the working surface.

Alternatively or in addition, the cutting surface 46 may have the pair of side edges including a first side edge 104 and a second side edge 106 that extend from the lower edge 49 to the upper cutting edge 109. Each of the side edges 104 or 106 may be non-parallel to the other of the side edges 104 or 106.

In some examples, the side edge 104 may include a curved portion 124. Alternatively, or in addition, the side edge 106 may include a curved portion 126, each having a predetermined radius of curvature that is equal, or that is different. Alternatively or in addition, both of the side edges 104 and 106 may have the curved portion 124 and 126 in such a manner such that the side edges 104 and 106 are non-parallel. In some examples, the upper cutting edge 109 extends linearly from the first side edge 104 to the second side edge 106. Alternatively or in addition, the lower edge 49 may extend linearly from the first side edge 104 to the second side edge 106. Alternatively or in addition, both the upper cutting edge 109 and the lower edge 49 may extend linearly from the first side edge 104 to the second side edge 106. Alternatively or in addition, the lower edge's 49 linear nature may align the lower edge 49 with an edge of the wear resistant element 14 or the partition 100. The alignment of the lower edge 49 and the edge of the wear resistant element 14 or partition 100 may assist in the alignment of the upper end 44 and the upper cutting edge 109 in the predetermined position at least by providing contiguous, linear interface, thus inhibiting rocking or movement of the cutter element 120.

Figure 13:
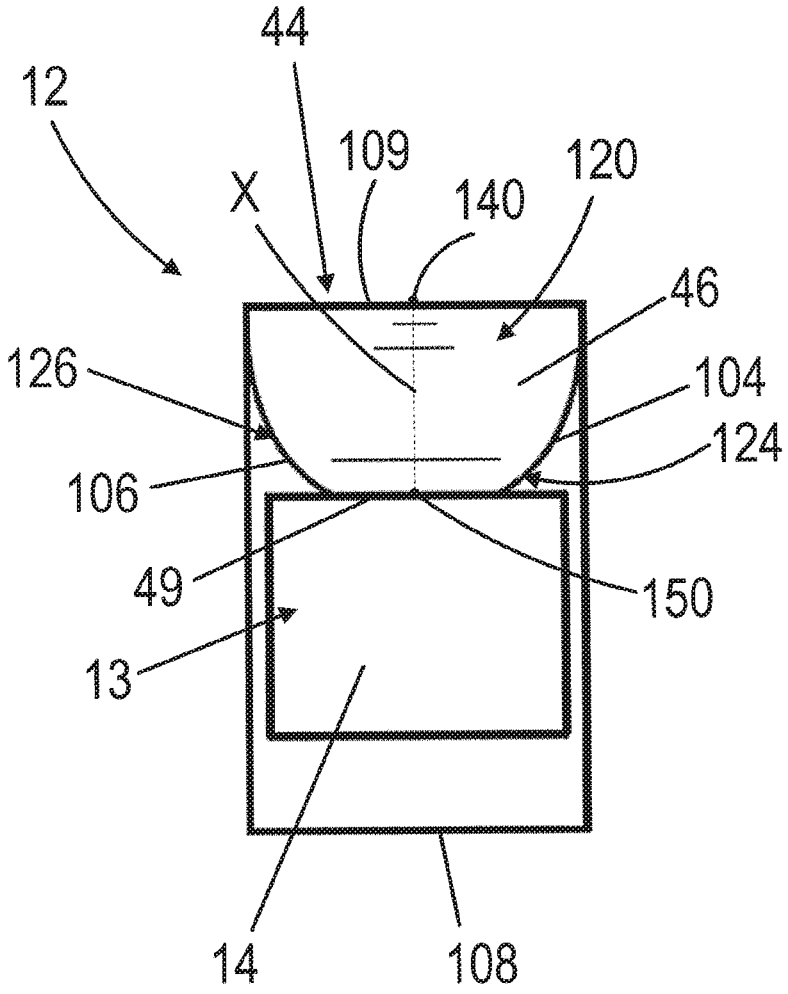
FIG. 13 is a front view of the example cutter bit of FIG. 12.

FIG. 13 is a front view of the example cutter bit of FIG. 12. As shown in FIG. 13, the cutting surface 46 may extend from the upper cutting edge 109 to the wear resistant element 14. In some examples, the wear resistant element 14 may be contiguously contacting, or positioned adjacent to the lower edge 49 of the cutting surface 46. In some examples, the cutting surface 46 may be symmetric about an axis X extending from a center-point 140 of the upper cutting edge 109 to a center-point 150 of the lower edge 49. Alternatively or in addition, as shown in FIG. 13, the lower edge 49 may align in parallel with an edge of the wear resistant element 14.

FIG. 14 is a side view of an example cutter bit 12. As shown in FIG. 14, the upper end 44 may be horizontally aligned with the upper cutting edge 109. The dotted lines in FIG. 14 show the bolt 1410 and the cavity 1430 which may be included in the cutter bit 12. The bolt 1410 is an example mechanism configured to position the cutter element 120 such that the upper cutting edge 109 and the upper end 44 are aligned during operation of the cutter bit 12 or installation of the cutter element 120. The bolt 1410 may be disengaged from the cutter element 120 and replaced. Alternatively or in addition, in some examples, disengagement of the bolt 1410 may further disengage the cutter element 120 from the cutter bit 12 to allow for replacement of the cutter element 120 by engaging threaded surface 1420 of the bolt 1410 with the threaded surface 1440 of the cavity 1430 of the replacement cutter element 120. The features shown in the example cutter bit 12 in FIG. 14 are not exclusive to the example shown in FIG. 14 and may be features included in other examples of the cutter bit 12 described herein.

The cutter element 120 may include the cutting surface 46 as a front face positioned to face away from the front surface 50 of the elongated body 42. Alternatively or in addition, the cutting surface 46 may be opposite the cutter element 120 from the planar back surface 128. The cutting surface may be positioned in a plane 132, as shown in FIG. 14, and the planar back surface 128 may be positioned in a plane 133. The planes 132 and 133 may be parallel in some examples.

Figure 15:
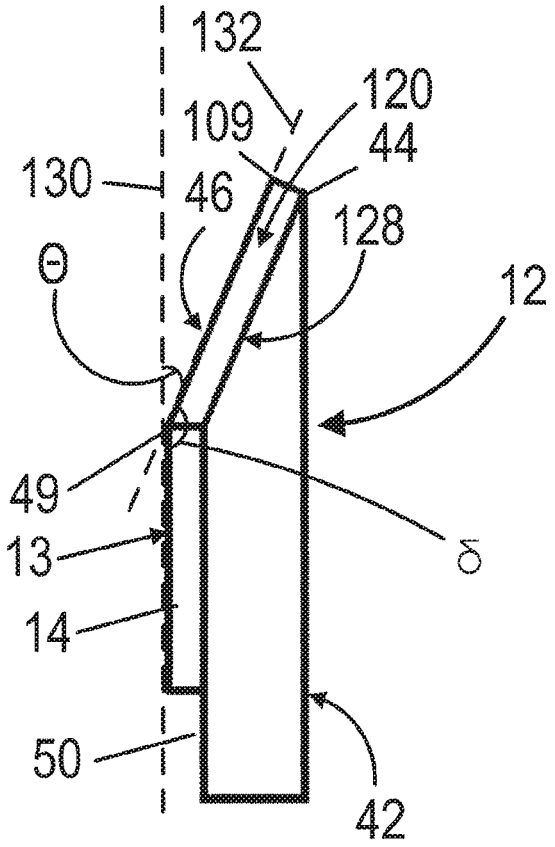
FIG. 15 is a side view of the example cutter bit of FIG. 12.
Figure 18:
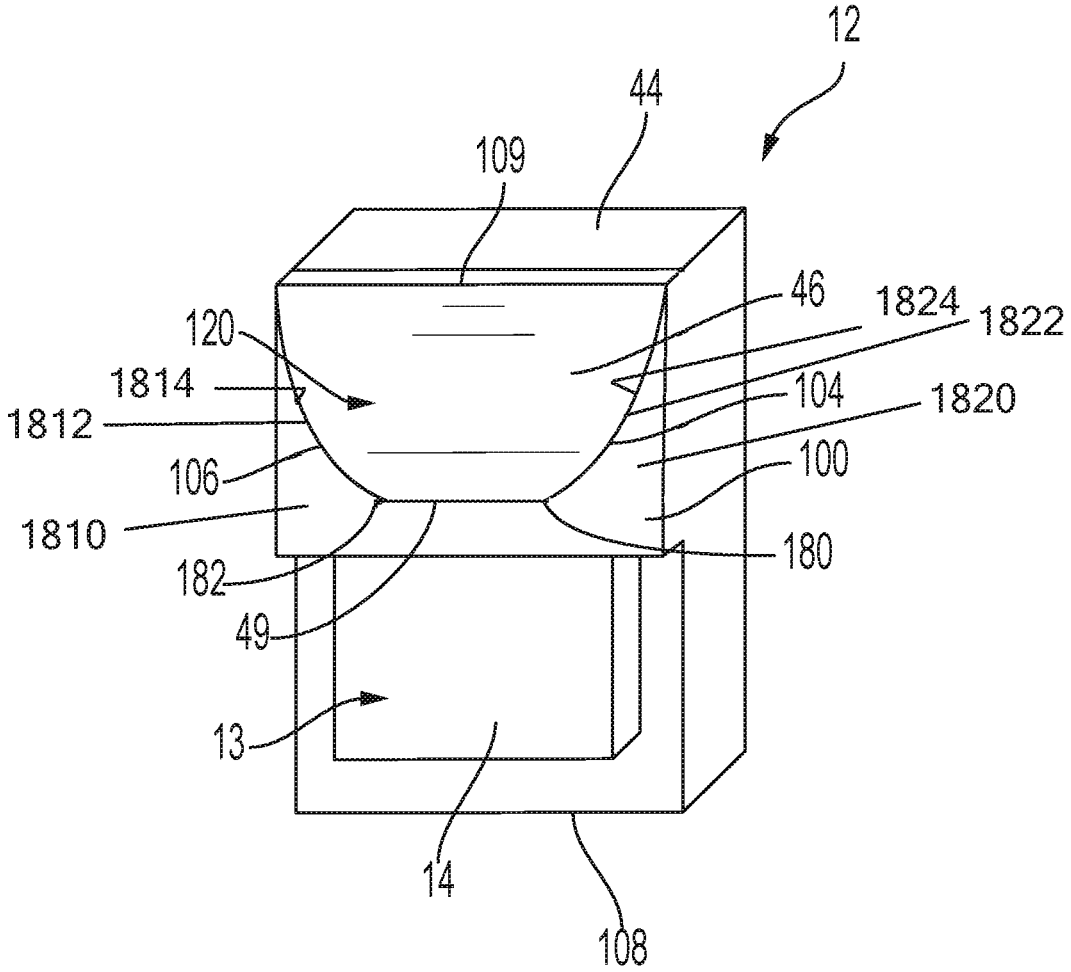
FIG. 18 is an isometric view of the example cutter bit of FIG. 16.

FIG. 15 is a side view of the example cutter bit 12 of FIG. 12. The example shown in FIG. 15 shows the plane 132 may include the cutting surface 46. A second plane 130 may be perpendicular to the working surface of a variety of roadway surface milling, planing, mining or reclaiming machines and may alternatively or in addition be parallel to the front surface 50. The first plane 132 and the second plane 130 may intersect to form a rake angle Θ with respect to each other. In some examples, the rake angle Θ may be between about 0 degrees and 20 degrees (+/−1 degree), inclusively. The lower edge 49 of the cutter element 120 may be contiguously aligned with the edge of the wear resistant element 14. Alternatively or in addition, the rake angle Θ may be a supplementary angle of an angle δ formed by the cutter element 120 and the wear resistant element 14 at the lower edge 49. Alternatively or in addition, the rake angle Θ may be an angle formed between a normal axis N to the working surface and a plane P including the front surface 50 as shown in FIG. 18. The lower edge 49 may be positioned such that the lower edge 49 abuts the wear resistant element 14 resulting in the upper cutting edge 109 being aligned with the upper end 44. Alternatively, the rake angle θ may be positive, that is to say that the plane 132 may be in the circumferential direction rather than the reverse circumferential direction. For example, FIG. 19 shows an example cutter bit 12 with a positive rake angle θ.

Figure 19:
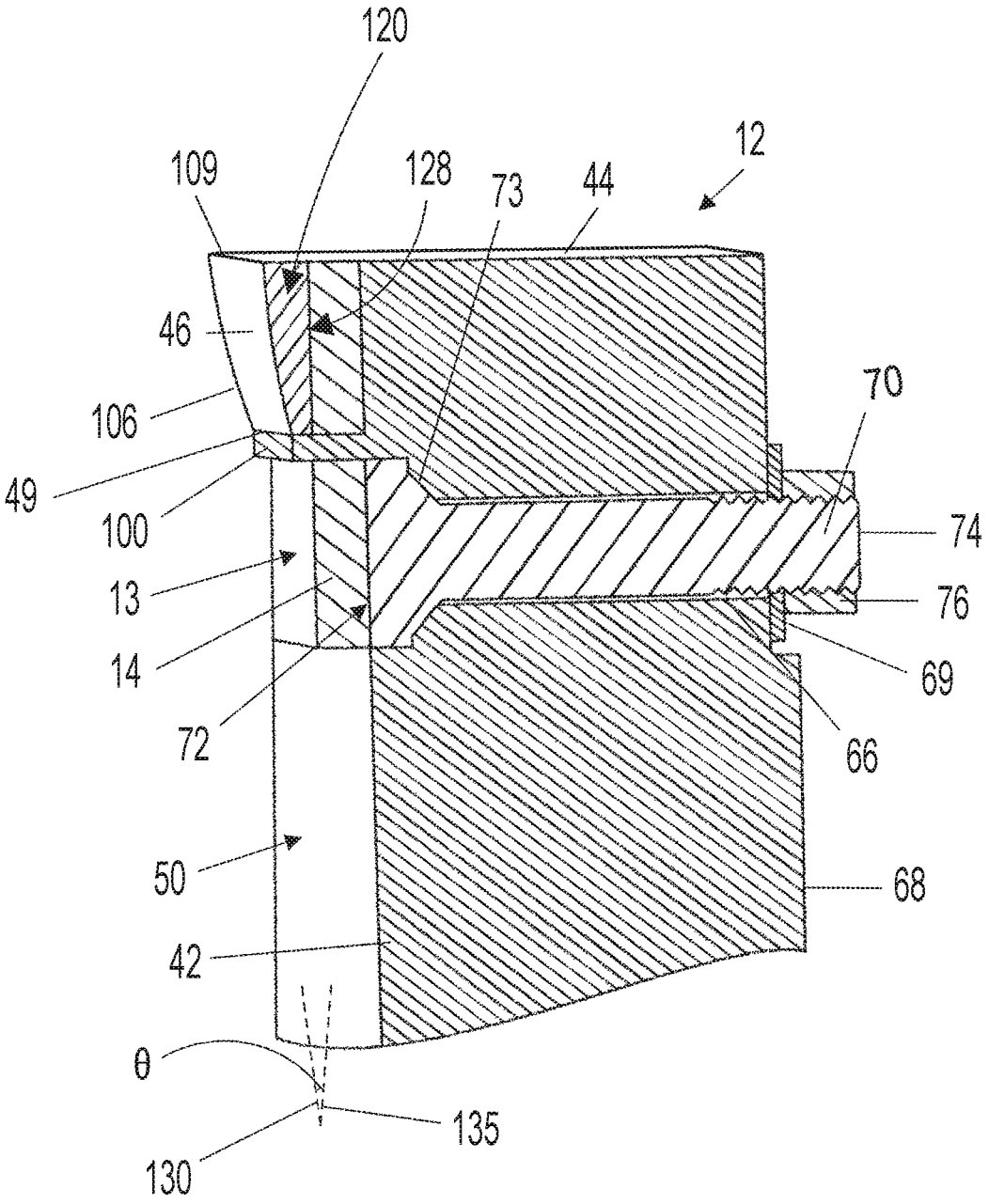
FIG. 19 is a sectional view of an upper portion of an example cutter bit including an angled notch having a surface inclined with respect to the back surface of a stem.

Other configurations of the cutter bit 12 are contemplated, for example, the example cutter bit 12 shown in FIG. 19. These other configurations of the cutter bit 12 may have the rake angle Θ as shown in the example cutter bit 12 illustrated in FIG. 15.

FIG. 16 shows a side view of an example of the cutter bit 12 including a partition 100 formed on the front surface 50 as part of the elongated body. In some examples, the cutter element 120 may be fixed to a side wall 1610 of the partition 100 by any suitable means such as welding or brazing. The side wall 1610 may be an edge of the partition formed in the elongated body 42. In some examples, the lower edge 49 may be contiguously aligned with the side wall 1610 in parallel resulting in alignments of the upper cutting edge 109 and the upper end 44.

The partition 100 may separate the wear resistant element 14 from the cutter element 120. The cutter bit 12 may include the rake angle Θ. The first plane 132 and the second plane 130 may intersect to form the rake angle Θ with respect to each other. In some examples, the rake angle Θ may be between about 0 degrees and 20 degrees (+/−1 degree), inclusively. The lower edge 49 of the cutter element 120 may be contiguously aligned with the edge of the partition 100. Alternatively or in addition, the rake angle Θ may be a supplementary angle of an angle δ formed by the cutter element 120 and the partition 100 at the lower edge 49. The lower edge 49 may be positioned such that the lower edge 49 abuts the partition 100 resulting in the upper cutting edge 109 being aligned with the upper end 44.

Figure 17:
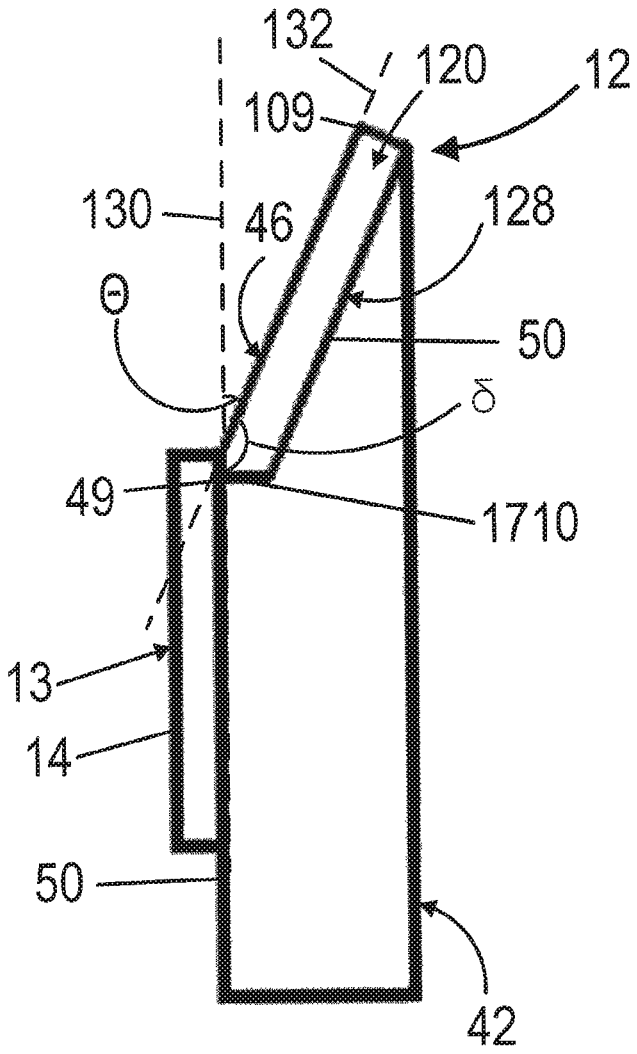
FIG. 17 is a side view of an example cutter bit.

FIG. 17 shows a side view of an example of the cutter bit 12. The example cutter bit 12 shown in FIG. 17 includes a ledge 1710, which is a partition, formed by a slot or recess of the front surface 50 of the cutter bit 12, which is sized to receive the cutter element 120. The cutter element 120 may be positioned in the slot so that the planar back surface 128 abuts the front surface 50 forming the slot. The ledge 1710, or partition, may be a protrusion of the front surface 50 of the cutter bit 12 extending in a direction circumferential to the working surface. The cutter element 120 may be fixedly attached to the ledge 1710 and/or the front surface 50 by, for example, brazing or welding. The ledge 1710 may be formed to accommodate the cutter bit and include a resting surface, such as a flat surface. The lower edge 49 may be positioned to abut or contiguously contact the resting surface of the ledge 1710 so that the lower edge 49 is positioned substantially parallel with resting surface of the ledge 1710 and also substantially parallel with at least one of the upper cutting edge 109, the working surface, and/or the bottom edge 108. Positioning the lower edge 49 in contiguous contact with the ledge 1710 may align the upper cutting edge 109 with the upper end 44. In an example, the front face 46 of the cutter element 120 and the front surface 50 of the cutter bit 12 below the cutter element 120 may be in a same vertical plane. In other examples, the cutter element 120 may be positioned such that the rake angle Θ is present wherein the front surface 50 is included in at least two distinct planes, as shown in FIG. 17. For example, FIG. 17 shows the front surface 50 of the cutter bit 12 included in two distinct planes (one parallel to the plane 130 and another parallel to the plane 132. The front surface included in more than one plane is not exclusive to the example shown in FIG. 17, and may be present in any example cutter bit 12 described herein. The ledge 1710, or partition, may be present in all examples described herein and is not limited to the example shown in FIG. 17. The ledge 1710 may be formed of a hardened steel or any material forming the elongated body 42.

The wear resistant element 14 may be fixedly attached to the front surface 50 and be positioned immediately adjacent to the ledge 1710. Alternatively or in addition, the wear resistant element 14 may be fixed to the front end 72 of the stem 70, as shown in FIG. 4, 10, or 19, for example. In some examples, as shown in FIG. 17, a portion of the wear resistant element 14 may be positioned to cover, or overlap, a portion of the front surface 46 of the cutter element 120. The portion of the wear resistant element 14 covering the portion of the cutter element 120 may deflect particulate matter away from the cutter bit 12 during operation of the cutter bit 12. Alternatively, in some examples, no portion of the wear resistant element 14 covers the front surface 46 of the cutter element 120. In some examples, the wear resistant element 14 may have an upper portion toward the cutter element 14 that is angled such that the surface of the upper portion is included within the plane 132, the plane 132 also including the cutting surface 46. In such a case, the surface of the upper portion of the wear resistant element 14 and the cutting surface 46 may be coplanar and/or form a continuous surface between the wear resistant element 14 and the cutter element 120. Alternatively, the wear resistant element 14 may have an upper portion angled to an angle different from alignment with the plane 132.

FIG. 18 shows an isometric view of an example of the cutter bit 12 shown in FIG. 16. The lower edge 49 may abut the partition 100 and the partition 100 may be contiguously linearly aligned with the lower edge 49 along a length of the lower edge 49. The side edge 104 may contact the partition 100 at a first point 180 and the side edge 106 may contact the partition 100 at a second point 182. The lower edge may linearly span a length between the points 180 and 182. Alternatively or in addition, the lower edge 49 may be fixed to the partition 100 by, for example brazing or welding. The lower edge 49 being fixed to the partition 100 may assist with keeping the upper cutting edge 109 and the upper end 44 aligned during operation of the cutter bit 12 and/or installation of the cutter element 120.

In some examples, a pair of side supports including a first side support 1810 and a second side support 1820 may be positioned on the partition 100 at least partially overlapping the cutter element 120. The first side support 1810 may include a side surface 1812 abutting the cutter element 120 on a first lateral surface 1814 of the cutter element 120, forming an interface. The interface including the first side surface 1812 and the first lateral surface 1814 may be over the entire first side surface 1812 and first lateral surface 1814. Alternatively, the interface including the first side surface 1812 and the first lateral surface 1814 may be over only a portion of the first side surface 1812, the first lateral surface 1814, or over only a portion of both the first side surface 1812 and the first lateral surface 1814. Alternatively or in addition, the second side support 1820 may include a second side surface 1822 abutting a second lateral surface 1824 the cutter element 120, forming an interface. The interface including the second side surface 1822 and the second lateral surface 1824 may be over the entire second side surface 1822 and second lateral surface 1824. Alternatively, the interface including the second side surface 1822 and the second lateral surface 1824 may be over only a portion of the second side surface 1822, the second lateral surface 1824, or over only a portion of both the second side surface 1822 and the second lateral surface 1824.

The side supports 1810 and 1820 may protrude radially from the partition 100. Alternatively, or in addition, the side supports 1810 and 1820 may protrude circumferentially from the front surface 50 of the cutter bit 12.

The side supports 1810 and 1820 may be support members that maintain the cutter element 120 in the predetermined position. For example, the first lateral surface 1814 of the cutter element 120 may be fixedly coupled with the first side surface 1812 of the first side support 1810, for example, by brazing or welding. Alternatively or in addition, the second lateral surface 1824 of the cutter element 120 may be fixedly coupled with the second side surface 1822 of the second side support 1820, for example, by brazing or welding. In this way, the side supports 1810 and 1820 maintain the predetermined position of the cutter element 120 at least because the cutter element 120 is fixedly coupled to one or both of the side supports 1810 and 1820. At least as a result of the side supports 1810 and 1820 positioning the cutter element 120 in the predetermined position, the side supports 1810 and 1820 may align in parallel the upper cutting edge 109 with the upper end 44, the bottom edge 108, and/or at least a portion of the working surface.

In some examples, the side supports 1810 and 1820 may be formed from steel, hardened steel, carbide steel, or similar materials. Alternatively or in addition, the side supports 1810 and 1820 may be alternative or additional wear resistant elements positioned on the cutter bit 12, similar to the wear resistant element 14.

A portion of the partition 100, a portion of the front surface 50, and the side surfaces 1812 and 1822 may define a slot to insert the cutter element 120. The cutter element 120 may be fixedly attached to any or all of the surfaces defining the slot such that the cutter bit 120 is maintained in the predetermined position. Alternatively or in addition, the cutter element 120 may be fixedly attached to any or all of the surfaces defining the slot such that the upper cutting edge 109 aligns substantially in parallel with the upper end 44, the bottom edge 108, and/or a portion of the working surface.

FIG. 19 shows a sectional view of an upper portion of an example of cutter bit 12. Examples cutter bits 12 shown in other figures are applicable to the example cutter bit 12 shown in FIG. 19 unless otherwise described. The rake angle Θ is shown in FIG. 19 as an angle formed between the plane 130 perpendicular to the working surface and a plane 135 including the front surface 50. The example cutter bit 12 shown in FIG. 19 includes the angled notch 67 having the surface 69 inclined with respect to the back surface 68 of the stem 70. The back surface 68, which may be generally parallel to the front surface 50 may include the angled notch 67 including the surface 69 inclined with respect to the back surface 68 of the body 42. The opening 66 may be perpendicular to the back surface 68 of the body 42 as similarly shown in the example of FIG. 4. Alternatively, the opening 66 may be perpendicular to the inclined surface 69 of the angled notch 67. The stem 70 having the front end 72 and the back end 74 may be received in the opening 66.

The wear resistant element 14 may be fixed to the front end 72 of the stem 70, by braze or weld. The fastener 76 may be removably coupled to the back end 74 of the stem 70 to secure the stem 70 in the opening 66. The stem 70 may include the tapered portion 73 which may act to ensure the proper positioning of the wear resistant element 14. Depending on the configuration of the front surface 13 of the wear resistant element 14, the wear resistant element 14 may be rotated upon experiencing non-uniform wear to lengthen the life of the wear resistant element 14. The wear resistant element 14 may be replaced, when needed, by removing the fastener 76 from the stem 70, and forcing the stem 70 from the opening 66, typically by a moderate tap from a hammer or the like. A new stem 70 having a new wear resistant element 14 on the front end 72 may then be inserted in the opening 66 and secured in place by fastener 76. This arrangement permits serial replacement of the wear resistant element 14 without requiring that the cutter bit 12 be removed from it mounting on the rotational drum, such as from the mounting block 10 holding the cutter bit, thereby lowering hardware replacement time and providing extended life for the cutter bit 12. The lower edge 49 may abut the partition 100 along the entire length of the lower edge 49. Such an arrangement may assist in keeping the cutter element 120 aligned during operation of a machine utilizing the cutting bit 12, thus allowing for consistent operation.

Figure 20:
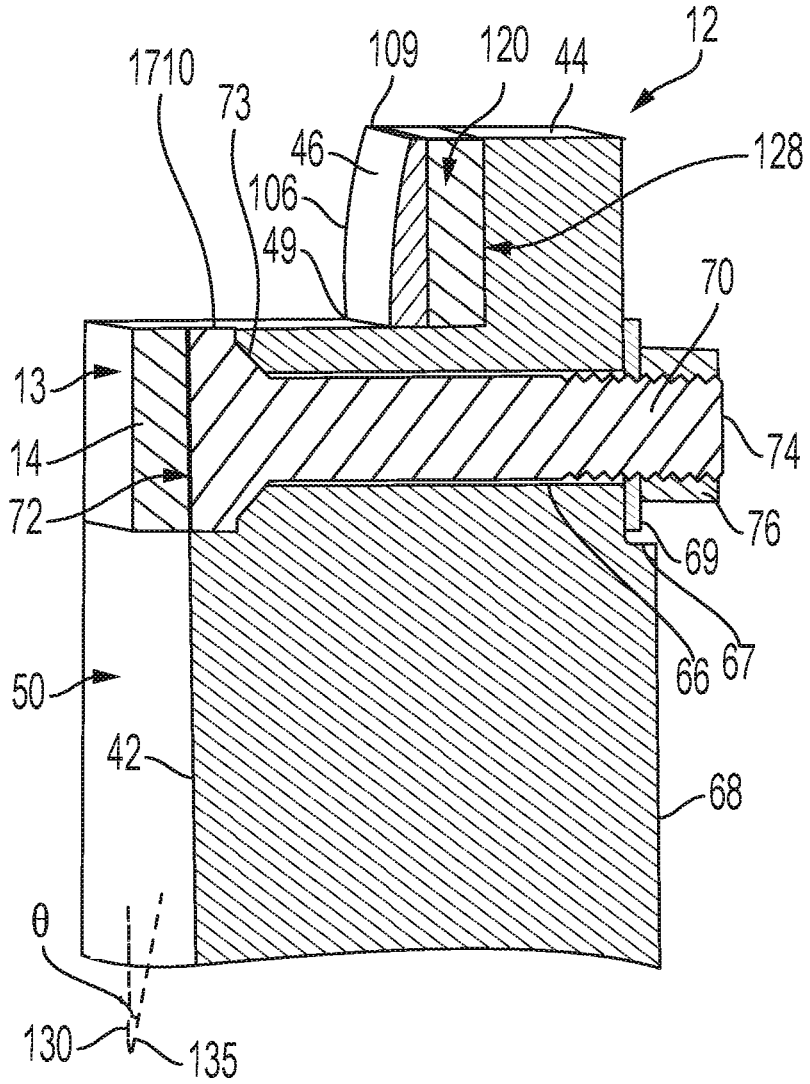
FIG. 20 is a sectional view of an upper portion of an example cutter bit.

FIG. 20 shows a sectional view of an upper portion of an example of cutter bit 12. As shown in FIG. 20, the cutter element 120 may be positioned toward the back surface 68 of the cutter bit 12 compared to the wear resistant element 14. The ledge 1710 may be in the same plane as an upper edge of the wear resistant member 14. Alternatively or in addition, the ledge 1710, the upper edge of the wear resistant element 14, and the lower edge 49 may all be positioned in the same plane. In some examples, the ledge 1710 may be positioned between the cutter element 120 and the wear resistant element 14 such that the cutter element 120 and the wear resistant element 14 do not overlap. In other examples, the cutter element 120 may overlap an edge of the wear resistant element 14.

The cutter element 120 may be positioned as far toward the back surface 68 as desired. As the cutter element 120 is positioned further toward the back surface 68, the rake angle θ may be adjusted such that the cutter element 120 would strike a surface at a consistent predetermined angle.

Figure 21:
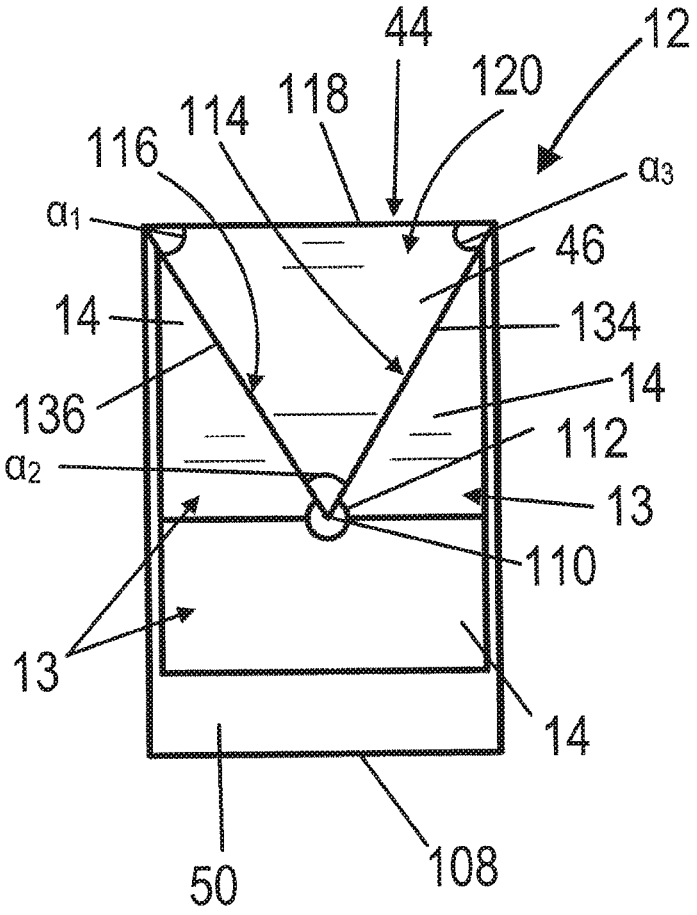
FIG. 21 is a front view of an example cutter bit having a cutting surface with three side edges and a cavity for housing of a tip of the cutting element.

FIG. 21 shows a front view of an example of a cutter bit 12. In the embodiment of the cutter bit 12 shown in FIG. 21, the cutter bit 12 has a generally rectangular body 42. In the embodiment shown in FIG. 21, the cutting surface 46 includes three edges defining a perimeter of the cutting surface 46, including an upper edge 118 and a pair of side edges 114 and 116. Alternatively, the wear resistant element 14 shown in FIG. 21 may be one, unitary, monolithic piece. Alternatively or in addition, the partition 100 may be included adjacent to the wear resistant member 14 toward the bottom edge 108 (not shown) to support the wear resistant member 14 and the cutter element 120 in position. Alternatively or in addition, the partition 100 (not shown) may be included adjacent to the wear resistant member 14 toward the bottom edge 108 to align the upper cutting edge 118 with the upper end 44. The upper edge 118 may be an upper cutting edge due to its position, however, the side edges 134 and 136 may also operate as an upper cutting edge if rotated into position of the upper edge 118. The upper edge 118 and the side edges 114 and 116, together, may define a substantially triangular surface. The cutter element 120 may be coupled to the front surface 50 by brazing or welding. Alternatively or in addition, the cutter element 120 may be coupled to the front surface 50 by a bolt, similar to the cutter bit 12 shown in FIG. 14.

Alternatively or in addition, the example shown in FIG. 21 may include the wear resistant element 14 adjacent to the cutter element 120. FIG. 21 shows three wear resistant elements 14. Any or all of the wear resistant elements 14 shown in FIG. 21 may be substituted with the partition 100. As shown in FIG. 21, the side edge 114 may be adjacent to a first edge 134 of the wear resistant element 14. The side edge 114 may contiguously align with the first edge 134 of the wear resistant element 14. In addition, the side edge 116 may be adjacent to a second edge 136 of the wear resistant element 14. The side edge 116 may contiguously align with the second edge 136 of the wear resistant element 14. The contiguous alignment of at least two of the cutter element 120 edges with at least two edges of the wear resistant element 14 may fixedly maintain the cutter element 120 aligned during installation of the cutter element 120 and during operation of a machine utilizing the cutter bit 12. In addition, the contiguous alignment of at least two of the cutter element 120 edges with at least two edges of the wear resistant element 14 may fixedly maintain the upper edge 118 aligned with the upper end 44 during operation of the cutter bit 12 and/or during installation of the cutter element 120.

Alternatively or in addition, the cutter bit 12 may include a cavity 112 for housing a tip 110 of the cutting element 120. The cavity 112 may be a recess on the front surface 50 of the cutter bit 12. The cavity 112 may be a recess that receives a portion 122 of the cutter element 120. The portion 122 may include the tip 110. The tip 110 may be a point on the cutting surface 46 where two of the three sides 118, 114, and 116 meet. The tip 110 may be deposited in the cavity 112. The cavity 112 may allow the portion 122 of the cutter element 120 or tip 110 space to avoid colliding with, scraping, or wearing against the wear resistant element 14. In some examples, the cutter element 120 may be positioned in a first orientation such that the upper edge 118 is furthest of the exactly three edges 118, 114, and 116 from the cavity 112. In some examples, the cutter element 112 is capable of being removed and repositioned in a second orientation such that, for example, side edge 114 is furthest of the exactly three edges 118, 114, and 116 from the cavity 112. In some examples, the cutter element 120 is capable of being removed and repositioned in a third orientation such that, for example, side edge 116 is furthest of the exactly three edges 118, 114, and 116 from the cavity 112. The capability of the second and third orientations allows for all three edges 118, 114, and 116 of a single cutter element 120 to each be individually used as the cutting edge.

In some examples, the side edge 118 and the side edge 116 linearly extend to intersect and form a first 60 degree angle $\alpha_1$, the side edge 116 and the side edge 114 linearly extend to intersect and form a second 60 degree angle $\alpha_2$, and the side edge 118 and the side edge 114 linearly extend to intersect and form a third 60 degree angle $\alpha_3$. As a result of the angles $\alpha_1$, $\alpha_2$, and $\alpha_3$ being 60 degrees, the cutter element 120 is configured to be rotated such that the side edge 114 or 116 be positioned as the cutting edge of the cutter element 120. Alternatively, each of the angles $\alpha_1$, $\alpha_2$, and $\alpha_3$ may be any desirable angle measurement such that the cutting surface 46 is generally triangular. As a result of any of the angles $\alpha_1$, $\alpha_2$, and $\alpha_3$ being different than 60 degrees, the cutter element 120 is not configured to be rotatable at least because the edges 114, 116, and 118 would not contiguously align with the respective edges 134 and 136 of the wear resistant element 14 after rotation.

The foregoing detailed description should be regarded as illustrative rather than limiting, and the following claims, including all equivalents, are intended to define the spirit and scope of this invention.

The invention claimed is:

1. A cutter bit, comprising:

an elongated body including a front surface, the elongated body adapted to be fixed onto a working surface of a rotating drum of a milling, planing, mining or reclaiming machine, the elongated body including an upper end;

a cutter element fixed to the front surface, the cutter element comprising polycrystalline diamond and including a front face positioned to face away from the front surface of the elongated body, the front face comprising:

an upper cutting edge forming a first linear peripheral edge of the front face;

a lower edge forming a second linear peripheral edge of the front face, wherein the lower edge is opposite the upper cutting edge;

a first side edge forming a third peripheral edge of the front face, the third peripheral edge being a first radial edge; and a second side edge forming a fourth peripheral edge of the front face, the fourth peripheral edge being a second radial edge concentrically disposed on the cutter element opposite the first radial edge, the upper cutting edge linearly extending to include a first end intersecting and terminating the first radial edge and a second end intersecting and terminating the second radial edge; wherein the upper cutting edge is parallel to the lower edge, the upper cutting edge is aligned with an upper end of the elongated body, the first radial edge and the second radial edge extend from the lower edge of the cutter element to the upper cutting edge, the first side edge is non-parallel to the second side edge, the upper cutting edge linearly extends from the first side edge to the second side edge and the lower edge linearly extends from the first side edge to the second side edge; and a wear resistant element fixed to the front surface of the elongated body.

2. The cutter bit of claim 1, wherein the first radial edge is in contact with an alignment surface of a partition formed in the front surface of the elongated body at a first point, the second radial edge is in contact with the alignment surface of the partition at a second point, the alignment surface is parallel to a cutting plane, the lower edge linearly extends from the first point to the second point, and the lower edge is operable to align the upper cutting edge substantially parallel with the working surface in a predetermined position such that the upper cutting edge is in the cutting plane.

3. The cutter bit of claim 2, wherein the elongated body further comprises a lower end forming a bottom edge opposite the upper end, the bottom edge substantially parallel to the upper cutting edge, the alignment surface, the cutting plane, the working surface, and the lower edge.

4. The cutter bit of claim 1, wherein the cutter element includes a planar back surface opposite the front face, the planar back surface contiguously held against the front surface of the elongated body via a fastener extending through the elongated body and coupled with the planar cutter element, and the front face being planar such that the planar back surface and the front face are in parallel planes.

5. The cutter bit of claim 1, wherein the wear resistant element includes an alignment surface, the first radial edge being in contact with the alignment surface of the wear resistant element at a first point, the second radial edge being in contact with the alignment surface of the wear resistant element at a second point, the alignment surface being parallel to a cutting plane, the lower edge linearly extends from the first point to the second point and contiguously aligns with the alignment surface of the wear resistant element, the lower edge contiguously aligned with the alignment surface of the wear resistant element to align the upper cutting edge substantially parallel with the working surface in a predetermined position such that the upper cutting edge is in the cutting plane.

6. The cutter bit of claim 5, wherein the cutter element and the wear resistant element are independently coupled with the elongated body, and wherein the alignment surface of the wear resistant element is wider than the lower edge of the cutter element, such that the alignment surface of the wear resistant element extends past the first point and the second point.

7. The cutter bit of claim 5, wherein the wear resistant element includes a first side support and a second side support, wherein the first side support extends contiguously along the first radial edge from the first point to the first end of the upper cutting edge and the second side support extends contiguously along the second radial edge from the second point to the second end of the upper cutting edge.

8. The cutter bit of claim 1, wherein a length of the lower edge of the cutter element is less than a length of the upper cutting edge of the cutter element.

9. The cutter bit of claim 1, wherein the first side edge is formed to include a first curved portion of a predetermined radius.

10. The cutter bit of claim 9, wherein the second side edge is formed to include a second curved portion of the predetermined radius.

11. The cutter bit of claim 1, wherein the front face is positioned such that a first plane including the front face and a second plane including the front surface form an angle between 0 degrees and 20 degrees, inclusively, between the first plane and the second plane.

12. The cutter bit of claim 1 wherein the elongated body further comprises a ledge protruding from the front surface, the lower edge positioned to abut the ledge to align the upper cutting edge substantially parallel with the lower edge.

13. The cutter bit of claim 1, wherein the lower edge is fixed to and aligned parallel with a partition formed in the front surface of the elongated body to align the upper cutting edge substantially parallel with the upper end.

14. The cutter bit of claim 1, wherein the upper cutting edge is aligned on the front surface of the elongated body to be substantially parallel with at least a portion of the working surface of the rotating drum.

15. The cutter bit of claim 1, wherein the wear resistant element is fixed to a first end of a stem, the stem extending through the elongated body, a second end of the stem receives a fastener at a back surface of the elongated body, and wherein the wear resistant element is fixed to the elongated body by the fastener and the stem.

16. The cutter bit of claim 1, further comprising a shelf formed in the front surface of the elongated body, the shelf comprising a flat surface, wherein the lower edge of the cutter element abuts the flat surface and is parallel to the flat surface, and wherein the wear resistant element is fixed to the front surface of the elongated body below the shelf such that the wear resistant element and the cutter element are spaced apart by at least a portion of the shelf.

17. A cutter bit, comprising:

an elongated body including a front surface, the elongated body adapted to be fixed onto a working surface of a rotating drum of a milling, planing, mining or reclaiming machine, the elongated body including an upper end;

a partition formed in the front surface of the elongated body, the partition including an alignment surface positioned in a plane parallel to a cutting plane;

a cutter element independently fixed to the front surface, the cutter element including a front face comprising an upper cutting edge forming a first peripheral edge of the front face, a lower edge forming a second peripheral edge of the front face, a first side edge forming a third peripheral edge of the front face, and a second side edge forming a fourth peripheral edge of the front face, wherein the upper cutting edge is parallel to the lower edge, the upper cutting edge is aligned with the working surface, the first side edge and the second side edge continuously extend from the lower edge of the cutter element to the upper cutting edge, the first side edge and the second side edge tapered away from each other and extending from the lower edge to the upper cutting edge such that the upper cutting edge is at a widest point of the cutter element, the upper cutting edge linearly extends from the first side edge to the second side edge and the lower edge linearly extends from the first side edge to the second side edge, and the first side edge contacts the alignment surface of the partition at a first point, the second side edge contacts the alignment surface of the partition at a second point such that the lower edge contiguously contacts and extends between the first point and the second point along the alignment surface to position the cutter element on the front surface in a predetermined position such that the upper cutting edge is in the cutting plane; and a wear resistant element fixed to the front surface of the elongated body.

18. The cutter bit of claim 17, wherein the wear resistant element extends along the front surface of the elongated body from the front surface of the elongated body past the first point, the second point, and the lower edge.

19. The cutter bit of claim 17, wherein the wear resistant element is fixed to a first end of a bolt, the bolt extending through the elongated body to receive a nut at a second end of the bolt, and wherein the wear resistant element is bolted to the elongated body such that a front surface of the wear resistant element is coplanar with the front face of the cutter element.

20. The cutter bit of claim 17, wherein the first side edge is a first radial edge and the second side edge is a second radial edge concentrically disposed on the cutter element opposite the first radial edge, and wherein the upper cutting edge and the lower edge are flat.

* * * * *